US011591057B2

(12) United States Patent
Perdomo Tornbaum et al.

(10) Patent No.: US 11,591,057 B2
(45) Date of Patent: Feb. 28, 2023

(54) PROPULSION DEVICES AND METHODS OF MAKING PROPULSION DEVICES THAT ALIGN PROPELLER BLADES FOR MARINE VESSELS

(71) Applicant: Brunswick Corporation, Mettawa, IL (US)

(72) Inventors: Andres Perdomo Tornbaum, Neenah, WI (US); Robert A. Podell, Slinger, WI (US); James E. Erickson, Fond du Lac, WI (US); Kenneth G. Gable, Fond du Lac, WI (US); Wayne M. Jaszewski, Jackson, WI (US); Derek J. Fletcher, Oshkosh, WI (US); Jeremy J. Kraus, Mt. Calvary, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/378,371

(22) Filed: Jul. 16, 2021

(65) Prior Publication Data

US 2022/0266968 A1 Aug. 25, 2022

Related U.S. Application Data

(63) Continuation-in-part of application No. 17/185,289, filed on Feb. 25, 2021.

(51) Int. Cl.
*B63H 20/10* (2006.01)
*B63H 5/125* (2006.01)
(Continued)

(52) U.S. Cl.
CPC ..... *B63H 5/125* (2013.01); *B63H 20/10* (2013.01); *B63H 21/17* (2013.01); *B63H 23/24* (2013.01); *B63H 2005/1258* (2013.01)

(58) Field of Classification Search
CPC ..... B63H 21/21; B63H 1/14; B63H 21/12; B63H 23/04; B63H 2005/1258;
(Continued)

(56) References Cited

U.S. PATENT DOCUMENTS 2,213,520 A 9/1940 Gentry
3,462,102 A 8/1969 Rivers
(Continued)

FOREIGN PATENT DOCUMENTS

EP 1611007 8/2007
EP 1914161 4/2008
(Continued)

OTHER PUBLICATIONS

International Search Report and Written Opinion for International Application No. PCT/CA/2016/050308 dated Jun. 9, 2016.

*Primary Examiner* — Andrew Polay
(74) *Attorney, Agent, or Firm* — Andrus Intellectual Property Law, LLP

(57) ABSTRACT

A propulsion device for marine vessel. A base is configured to be coupled to the marine vessel, the base having sides that extend downwardly from the marine vessel. A propulsor is pivotally coupled to the base and pivotable into and between a deployed position and a stowed position. The propulsor comprises a propeller having a hub with blades extending away therefrom. The propulsor is configured to propel the marine vessel in water when in the deployed position by rotating the propeller. An alignment device aligns the blades of the propeller between the sides of the base when the propulsor is in the stowed position.

20 Claims, 20 Drawing Sheets

(51) Int. Cl.
*B63H 21/17* (2006.01)
*B63H 23/24* (2006.01)

(58) Field of Classification Search
CPC ..... B63H 2025/425; B63H 20/007; B63H 20/10; B63H 20/106; B63H 20/08; B63B 1/125; B63B 35/38; B63B 79/10; B63B 35/613
See application file for complete search history.

(56) References Cited

U.S. PATENT DOCUMENTS

| | | | | |
|---|---|---|---|---|
| 3,865,335 | A | 2/1975 | Roller et al. | |
| 3,874,318 | A | 4/1975 | Langley | |
| 3,995,579 | A | 12/1976 | Childre | |
| 3,999,500 | A | 12/1976 | Friedel et al. | |
| 4,008,680 | A | 2/1977 | Alexander, Jr. | |
| 4,294,186 | A | 10/1981 | Wardell | |
| 4,410,161 | A | 10/1983 | Booty | |
| 4,734,068 | A | 3/1988 | Edwards | |
| 4,875,656 | A | 10/1989 | Boede | |
| 4,911,398 | A | 3/1990 | Diiulio et al. | |
| 4,966,566 | A | 10/1990 | Baird | |
| 5,005,798 | A | 4/1991 | McCoy | |
| 5,022,609 | A | 6/1991 | Cranston | |
| 5,131,875 | A | 7/1992 | Lee | |
| 5,152,240 | A | 10/1992 | Fontanille | |
| 5,277,630 | A | 1/1994 | Clark | |
| 5,499,792 | A | 3/1996 | Tamiso | |
| 5,669,794 | A | 9/1997 | Knight et al. | |
| 5,941,742 | A | 8/1999 | Whitaker | |
| 6,142,841 | A | 11/2000 | Alexander, Jr. et al. | |
| 6,280,267 | B1 | 8/2001 | Griffith, Sr. et al. | |
| 6,325,685 | B1 | 12/2001 | Knight et al. | |
| 6,431,923 | B1 | 8/2002 | Knight et al. | |
| 6,592,412 | B1 | 7/2003 | Geil et al. | |
| 6,789,648 | B2 | 9/2004 | Cook | |
| 7,004,803 | B2 | 2/2006 | Ruffe | |
| 7,004,804 | B2 | 2/2006 | Bernloehr et al. | |
| RE39,032 | E | 3/2006 | Gonring et al. | |
| 7,150,662 | B1 * | 12/2006 | Janitz | B63H 25/42 114/144 RE |
| 7,285,029 | B1 | 10/2007 | Janitz | |
| 7,294,029 | B1 | 11/2007 | Spaulding | |
| 7,305,928 | B2 | 12/2007 | Bradley et al. | |
| 7,510,450 | B1 | 3/2009 | Dresher | |
| 7,520,239 | B2 | 4/2009 | Bryham | |
| 7,753,745 | B2 | 7/2010 | Schey et al. | |
| 7,887,381 | B2 | 2/2011 | Brass et al. | |
| 7,946,243 | B1 | 5/2011 | Ulrich | |
| 8,051,793 | B2 | 11/2011 | Ulgen | |
| 8,479,677 | B2 | 7/2013 | Bolline et al. | |
| 9,296,455 | B2 | 3/2016 | Bernloehr et al. | |
| 9,586,655 | B1 | 3/2017 | Butler | |
| 9,738,364 | B2 | 8/2017 | Abney | |
| 9,889,914 | B1 * | 2/2018 | Ostrowsky | B63H 20/16 |
| 9,896,162 | B2 | 2/2018 | McClure | |
| 10,167,069 | B2 | 1/2019 | Houle et al. | |
| 2005/0159053 | A1 | 7/2005 | Ruffe | |
| 2010/0136857 | A1 | 6/2010 | Goudsmit | |
| 2017/0203823 | A1 * | 7/2017 | Abney | B63H 25/42 |
| 2017/0341718 | A1 * | 11/2017 | Zimmerman | B63H 23/18 |
| 2018/0057130 | A1 * | 3/2018 | Houle | B63H 20/06 |

FOREIGN PATENT DOCUMENTS

| | | |
|---|---|---|
| EP | 2757037 | 7/2014 |
| EP | 2242678 | 11/2015 |
| EP | 2246252 | 5/2019 |
| JP | 2013100013 | 5/2013 |

* cited by examiner

PROPULSION DEVICES AND METHODS OF MAKING PROPULSION DEVICES THAT ALIGN PROPELLER BLADES FOR MARINE VESSELS

CROSS REFERENCE TO RELATED APPLICATION

This application is a continuation-in-part of U.S. patent application Ser. No. 17/185,289, filed Feb. 25, 2021, which is incorporated herein by reference in its entirety.

FIELD

The present disclosure generally relates to stowable propulsors for marine vessels.

BACKGROUND

The following U.S. Patents provide background information and are incorporated by reference in entirety.

U.S. Pat. No. 6,142,841 discloses a maneuvering control system which utilizes pressurized liquid at three or more positions of a marine vessel to selectively create thrust that moves the marine vessel into desired locations and according to chosen movements. A source of pressurized liquid, such as a pump or a jet pump propulsion system, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired.

U.S. Pat. No. 7,150,662 discloses a docking system for a watercraft and a propulsion assembly therefor wherein the docking system comprises a plurality of the propulsion assemblies and wherein each propulsion assembly includes a motor and propeller assembly provided on the distal end of a steering column and each of the propulsion assemblies is attachable in an operating position such that the motor and propeller assembly thereof will extend into the water and can be turned for steering the watercraft.

U.S. Pat. No. 7,305,928 discloses a vessel positioning system which maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,753,745 discloses status indicators for use with a watercraft propulsion system. An example indicator includes a light operatively coupled to a propulsion system of a watercraft, wherein an operation of the light indicates a status of a thruster system of the propulsion system.

U.S. Pat. No. RE39032 discloses a multipurpose control mechanism which allows the operator of a marine vessel to use the mechanism as both a standard throttle and gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second, and third secondary control signals relating to desired maneuvers of the marine vessel.

European Patent Application No. EP 1,914,161, European Patent Application No. EP2,757,037, and Japanese Patent Application No. JP2013100013A also provide background information and are incorporated by reference in entirety.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure generally relates to propulsion devices for marine vessel. In one example, a base is configured to be coupled to the marine vessel, the base having sides that extend downwardly from the marine vessel. A propulsor is pivotally coupled to the base and pivotable into and between a deployed position and a stowed position. The propulsor comprises a propeller having a hub with blades extending away therefrom. The propulsor is configured to propel the marine vessel in water when in the deployed position by rotating the propeller. An alignment device aligns the blades of the propeller between the sides of the base when the propulsor is in the stowed position.

The present disclosure further relates to methods for making a propulsion device for a marine vessel. The method includes configuring a base for coupling to the marine vessel, the base having sides that extend downwardly from the marine vessel. The method further includes pivotally coupling a propulsor to the base, the propulsor being pivotable into and between a deployed position and a stowed position, where the propulsor comprises a propeller having a hub with blades extending away therefrom, and where the propulsor is configured to propel the marine vessel in water when in the deployed position by rotating the propeller. The method further includes coupling an alignment device between the propeller and the base, where the alignment device is configured to align the blades of the propeller between the sides of the base when the propulsor is in the stowed position.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

The present inventors have recognized a problem with bow thrusters presently known in the art, and particularly those that are retractable for storage. Specifically, within the context of a marine vessel having pontoons, there is insufficient clearance between the pontoons to accommodate a propulsive device, and particularly a propulsive device oriented to create propulsion in the port-starboard direction. The problem is further exacerbated when considering how marine vessels are trailered for transportation over the road. One common type of trailer is a scissor type lift in which bunks are positioned between the pontoons to lift the vessel by the underside of the deck. An exemplary lift of this type is the "Scissor Lift Pontoon Trailer" manufactured by Karavan in Fox Lake, Wis. In this manner, positioning a bow thruster between a marine vessel's pontoons either precludes the use of a scissor lift trailer, or leaves so little clearance that damage to the bow thruster and/or trailer is likely to occur during insertion, lifting, and/or transportation of the vessel on the trailer. This can also be an issue with bunk trailers and/or shore stations having guides that go on the inside of the pontoons. As such, the present inventors have realized it would be advantageous to rotate the propulsor in a fore-aft orientation when stowed to minimize the width of the bow thruster. Additionally, the present inventors have recognized the desirability of developing such a rotatable propulsor that does not require additional actuators for this rotation, adding cost and complexity to the overall system.

Figure 1:
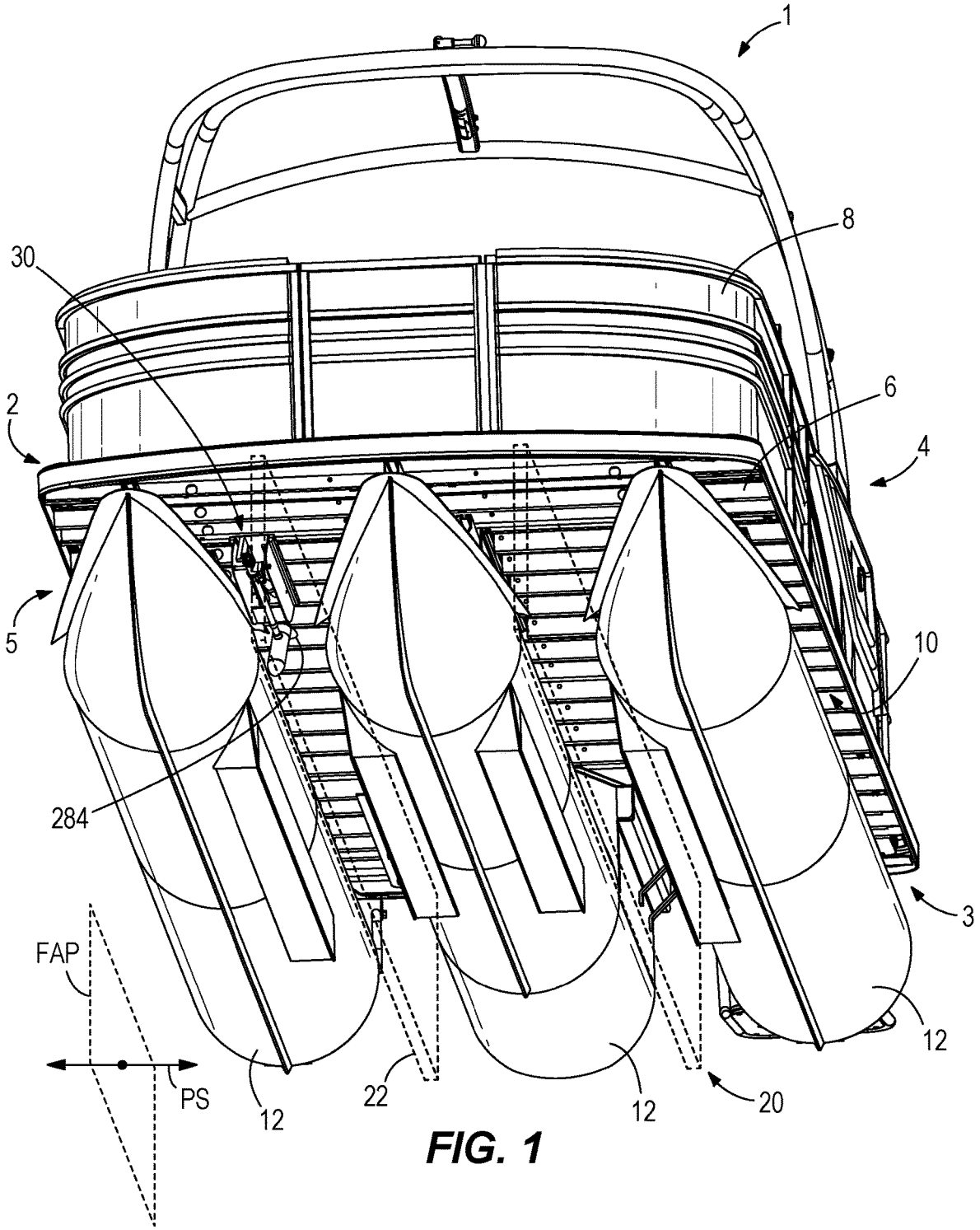
FIG. 1 is an isometric bottom view of a propulsion device coupled to a marine vessel and having a propulsor.

FIG. 1 depicts the underside of a marine vessel 1 as generally known in the art, but outfitted with an embodiment of a stowable propulsion device 30 according to the present disclosure. The marine vessel 1 extends between a bow 2 and a stern 3, as well as between port 4 and starboard 5 sides, thereby defining a fore-aft plane FAP, and port-starboard direction PS. The marine vessel 1 further includes a deck 6 with a rail system 8 on top and pontoons 12 mounted to the underside 10 of the deck 6. The marine vessel 1 is shown with a portion of a scissor type lift 20, specifically the bunks 22, positioned between pontoons 12 to lift and support the marine vessel 1 for transportation over land in a manner known in the art. As is discussed further below, embodiments of a novel stowable propulsion device 30 have a propeller 284 that faces the underside 10 of the deck 6 when stowed, in contrast to during use to propel the marine vessel 1 in the water as a bow thruster. This is distinguishable from propulsion devices known in the art, in which the propeller faces the pontoons. In prior art configurations, there typically is insufficient room between the propulsion device and the pontoons to fit the bunks of the scissor type lift without risking damage to the propulsion device while inserting the bunks, lifting the marine vessel, and/or traveling on the road.

Figure 2:
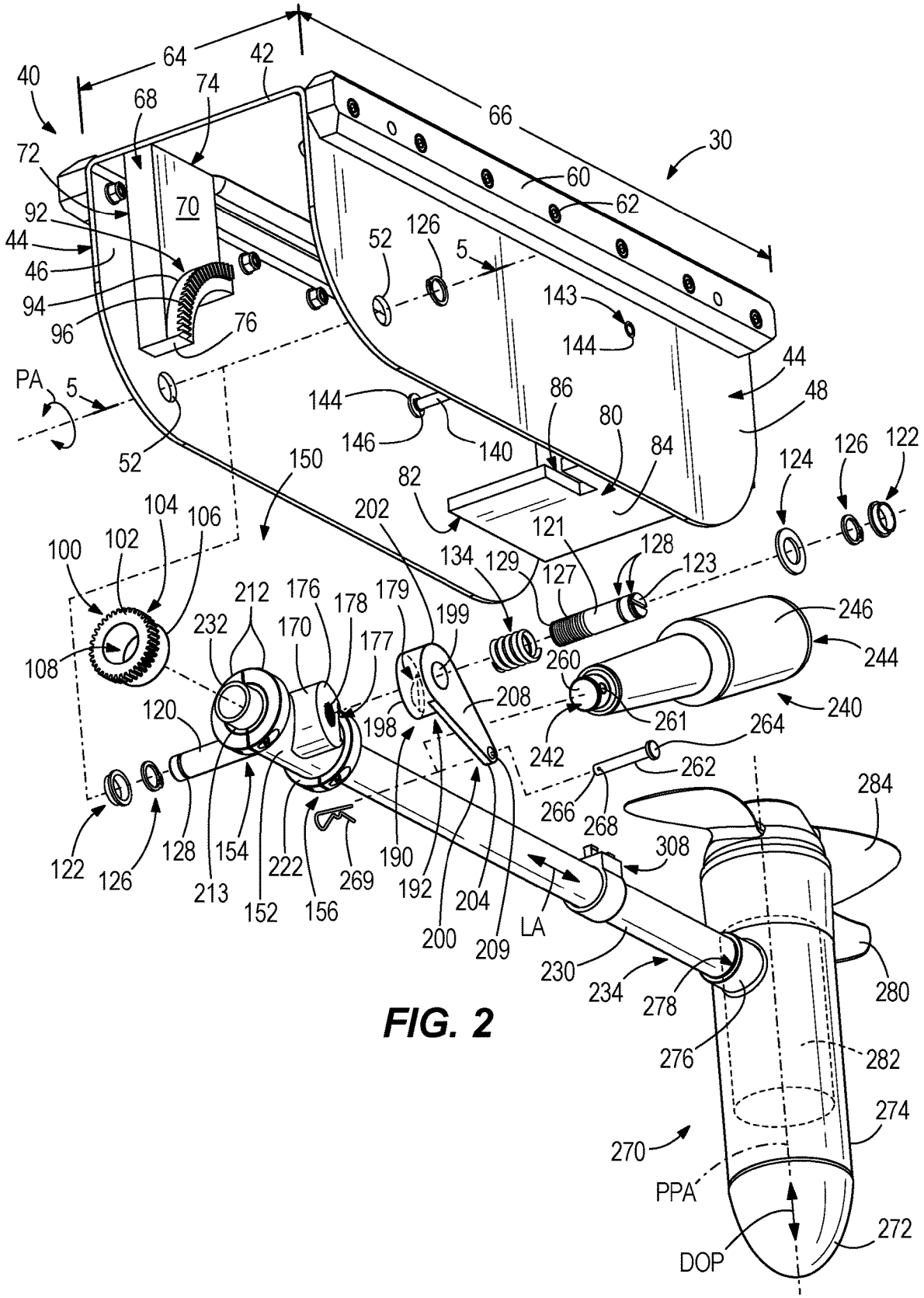
FIG. 2 is an exploded isometric view showing the propulsor from FIG. 1 in a stowed position.
Figure 3:
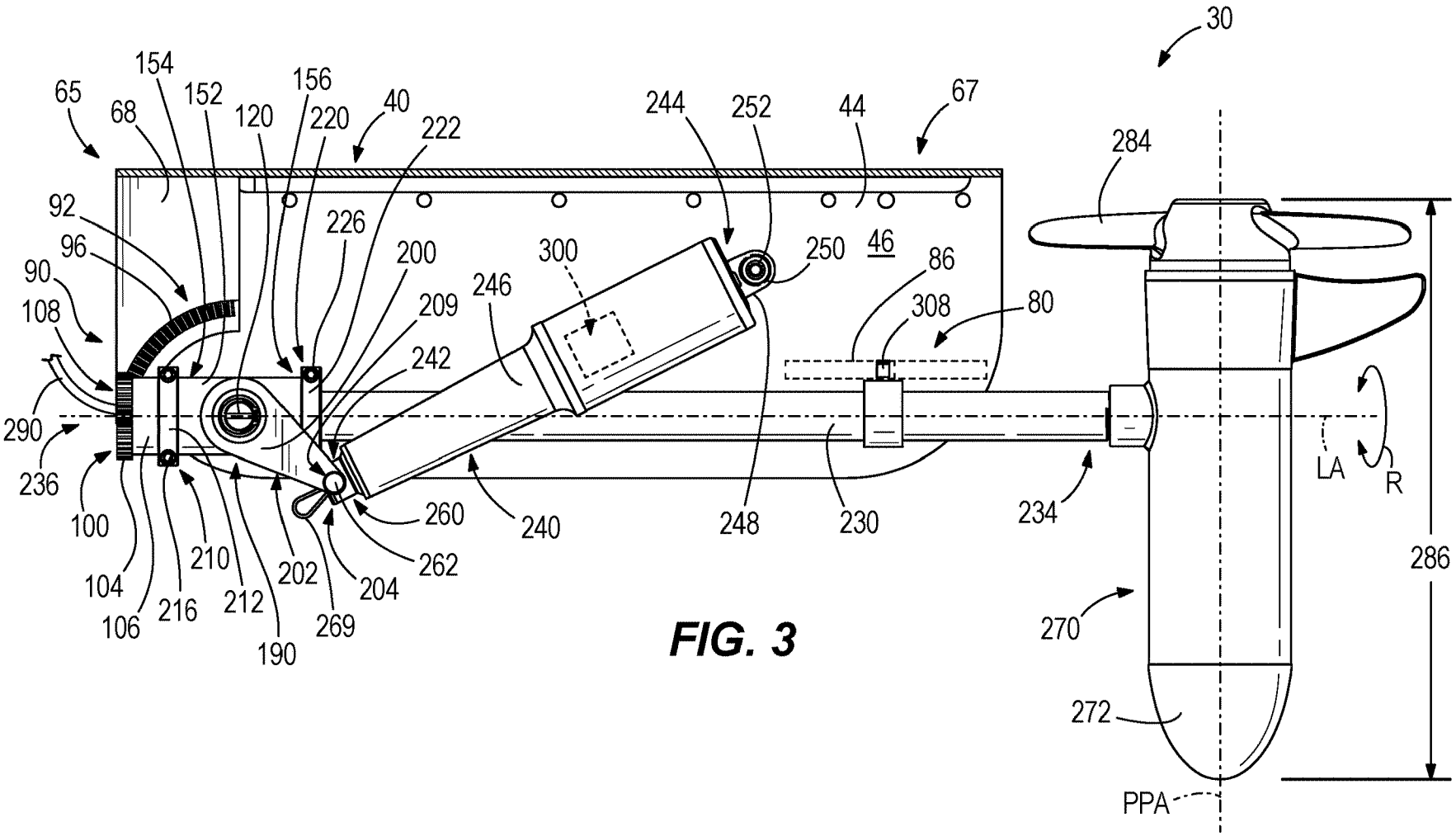
FIG. 3 is a sectional side view of the propulsion device shown in FIG. 2.
Figure 4:
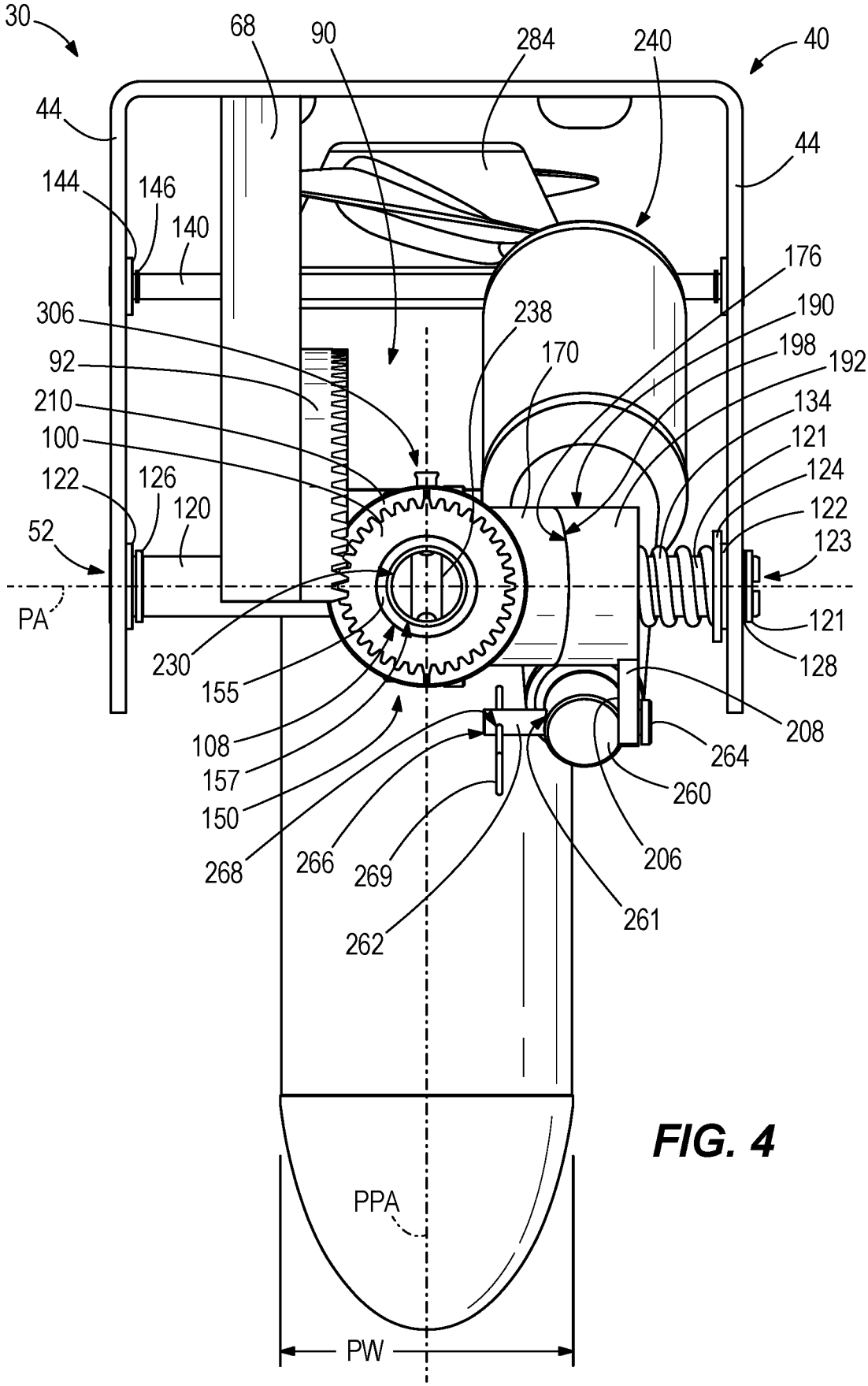
FIG. 4 is a rear view of the propulsion device shown in FIG. 2.

FIGS. 2-3 depict an exemplary stowable propulsion device 30 according to the present disclosure, here oriented in a stowed position. The stowable propulsion device 30 includes a base 40 having a top 42 with sides 44 extending perpendicularly downwardly away from the top 42. The sides 44 include an inward side 46 and outward side 48 and extend between a first end 65 and second end 67 defining a length 66 therebetween. A width 64 is defined between the sides 44. A stop 80 having sides 82 and a bottom 84 is coupled between the sides 44 of the base 40. A leg 68 having an inward side 70 and outward side 72 extends between a top end 74 and a bottom end 76. The leg 68 is coupled at the top end 74 to the top 42 of the base 40 and extends perpendicularly downwardly therefrom. A stationary gear 92 having a mesh face 96 with gear teeth and an opposite mounting face 94 is coupled to the leg 68 with the mounting face 94 facing the inward side 70 of the leg 68. As shown in FIG. 4, one or more support rods 140 may also be provided between the sides 44 and received within support rod openings 143 defined therein to provide rigidity to the base 40. In the example shown, the support rod 140 is received within a bushing 144 and held in position by a snap ring 146 received within a groove defined within the support rod 140.

Returning to FIGS. 2-3, the base 40 is configured to be coupled to the marine vessel 1 with the top 42 facing the underside 10 of the deck 6. The base 40 may be coupled to the deck 6 using fasteners and brackets presently known in the art. A mounting bracket 60 is coupled via fasteners 62 (e.g., screws, nuts and bolts, or rivets) to the outward sides 48 of the sides 44 of the base 40. The mounting bracket 60 is receivable in a C-channel bracket or other hardware known in the art (not shown) that is coupled to the deck 6 and/or pontoons 12 to thereby couple the stowable propulsion device 30 thereto.

As shown in FIGS. 2-4, the stowable propulsion device 30 includes a shaft 230 that extends between a proximal end 232 and distal end 234 defining a length axis LA therebetween. The proximal end 232 of the shaft 230 is non-rotatably coupled to a moving gear 100. The moving gear 100 has a proximal face 102 and mesh face 104 having gear teeth, where the mesh face 104 engages with the mesh face 96 of the stationary gear 92 to together form a gearset 90 as discussed further below. The moving gear 100 further includes a barrel 106 that extends perpendicularly relative to the proximal face 102 and is coupled to the shaft 230 in a manner known in the art (e.g., via a set screw or welding). In this manner, the moving gear 100 is fixed to the shaft 230 such that rotation of the moving gear 100 causes rotation of the shaft 230 about the length axis LA.

Figure 5:
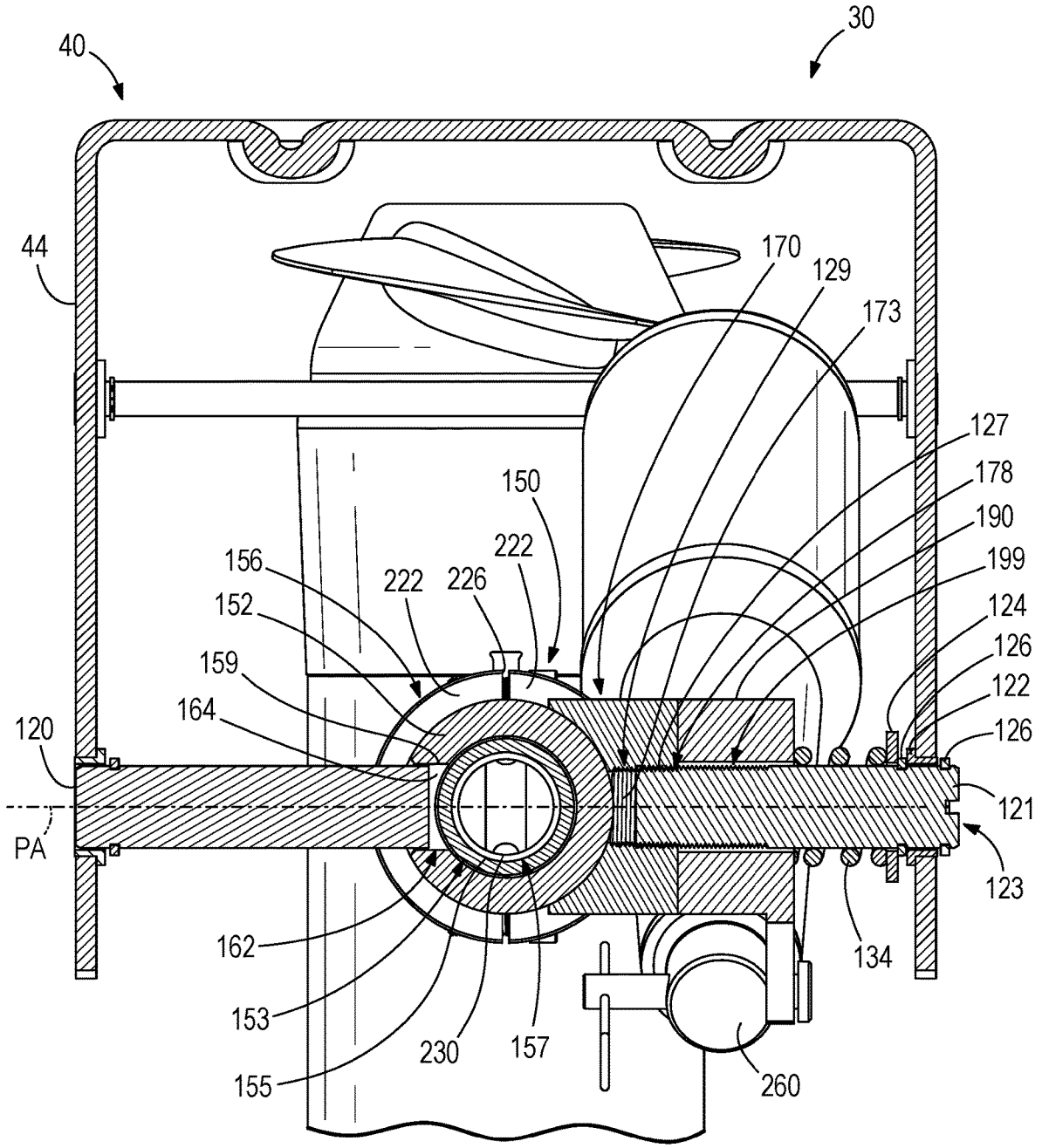
FIG. 5 is a sectional view taken along the line 5-5 of FIG. 2.
Figure 6:
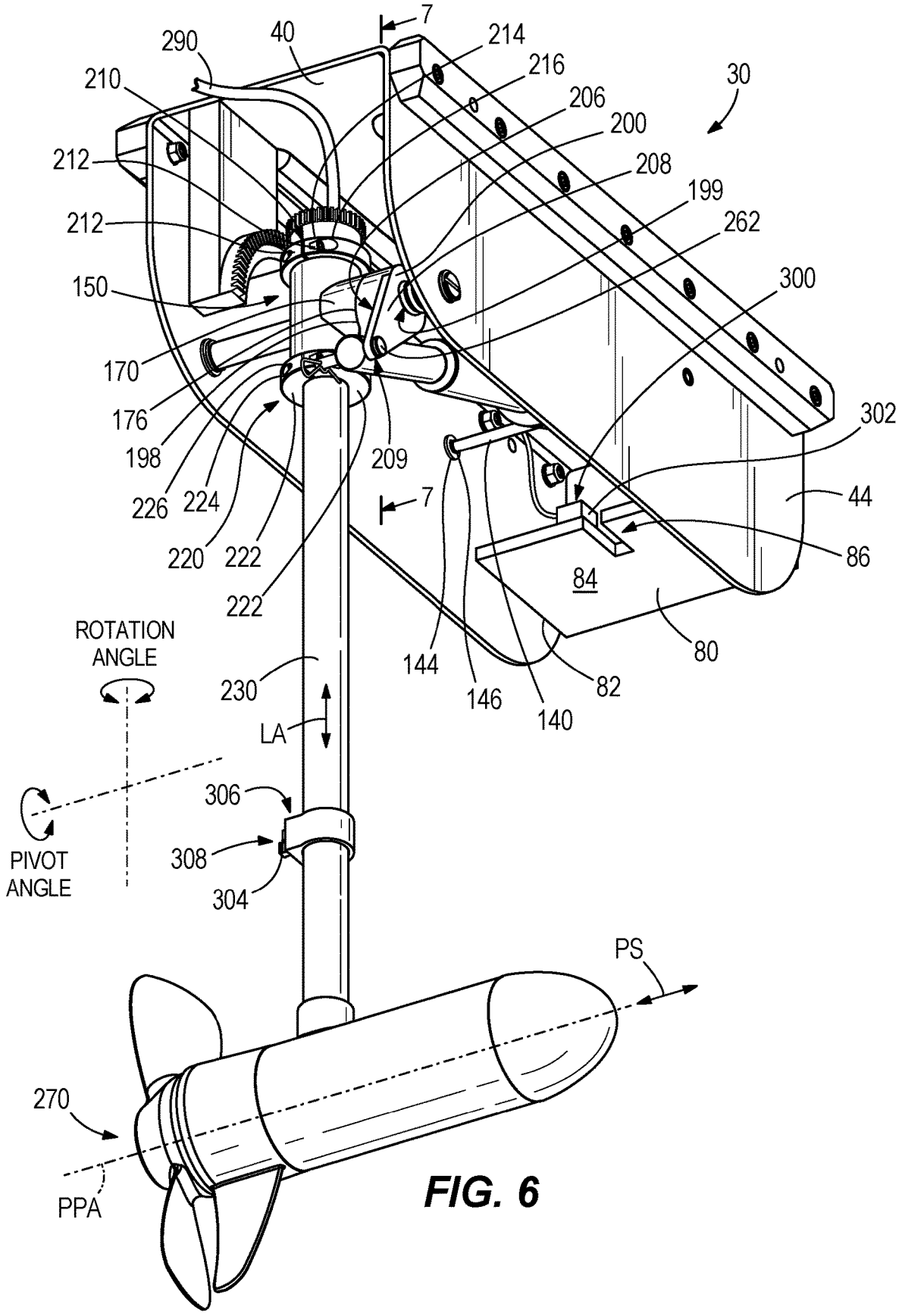
FIG. 6 is an isometric bottom view showing the propulsor from FIG. 2 in a deployed position.
Figure 7:
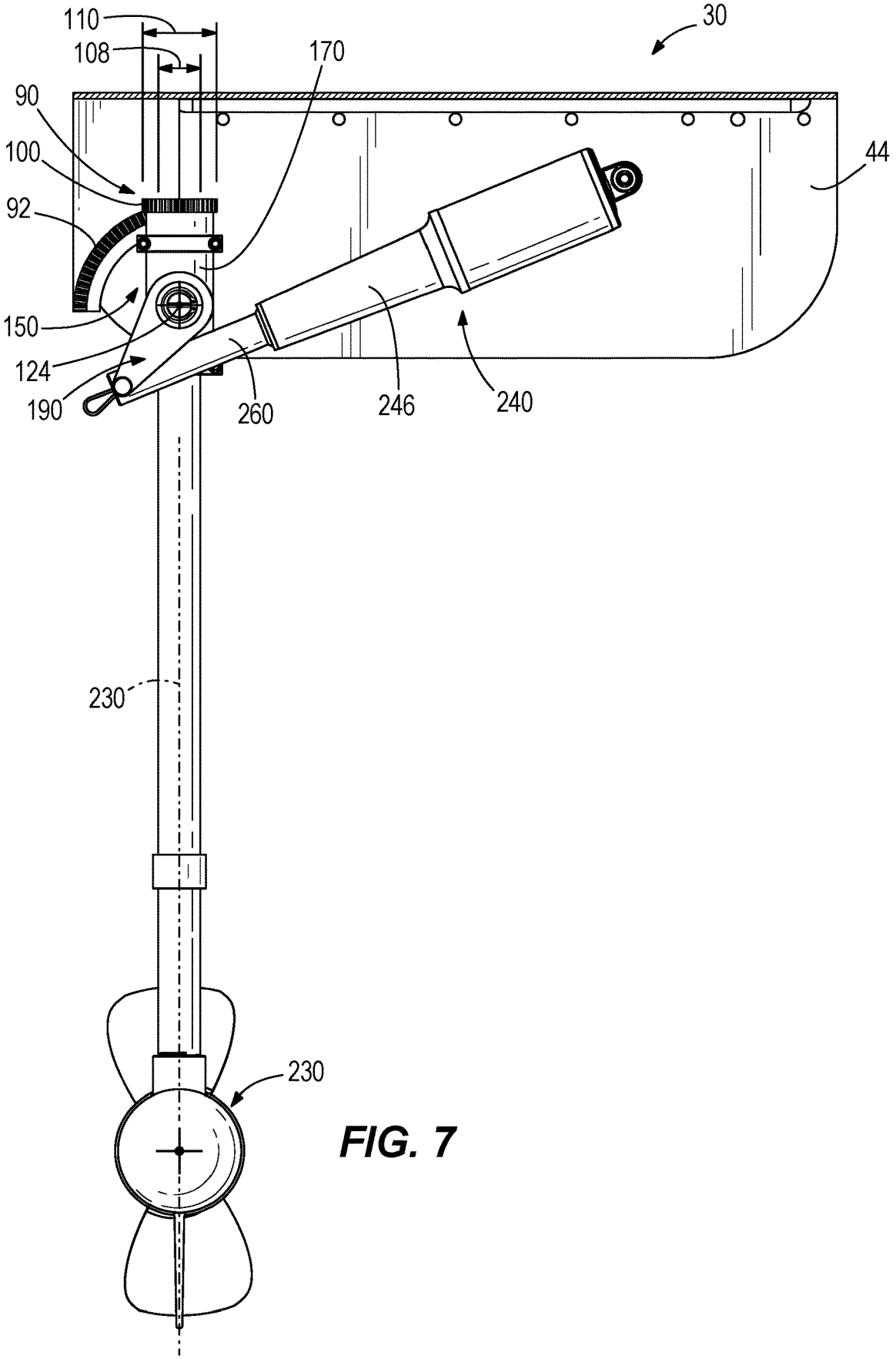
FIG. 7 is a sectional side view taken along the line 7-7 in FIG. 6.
Figure 8:
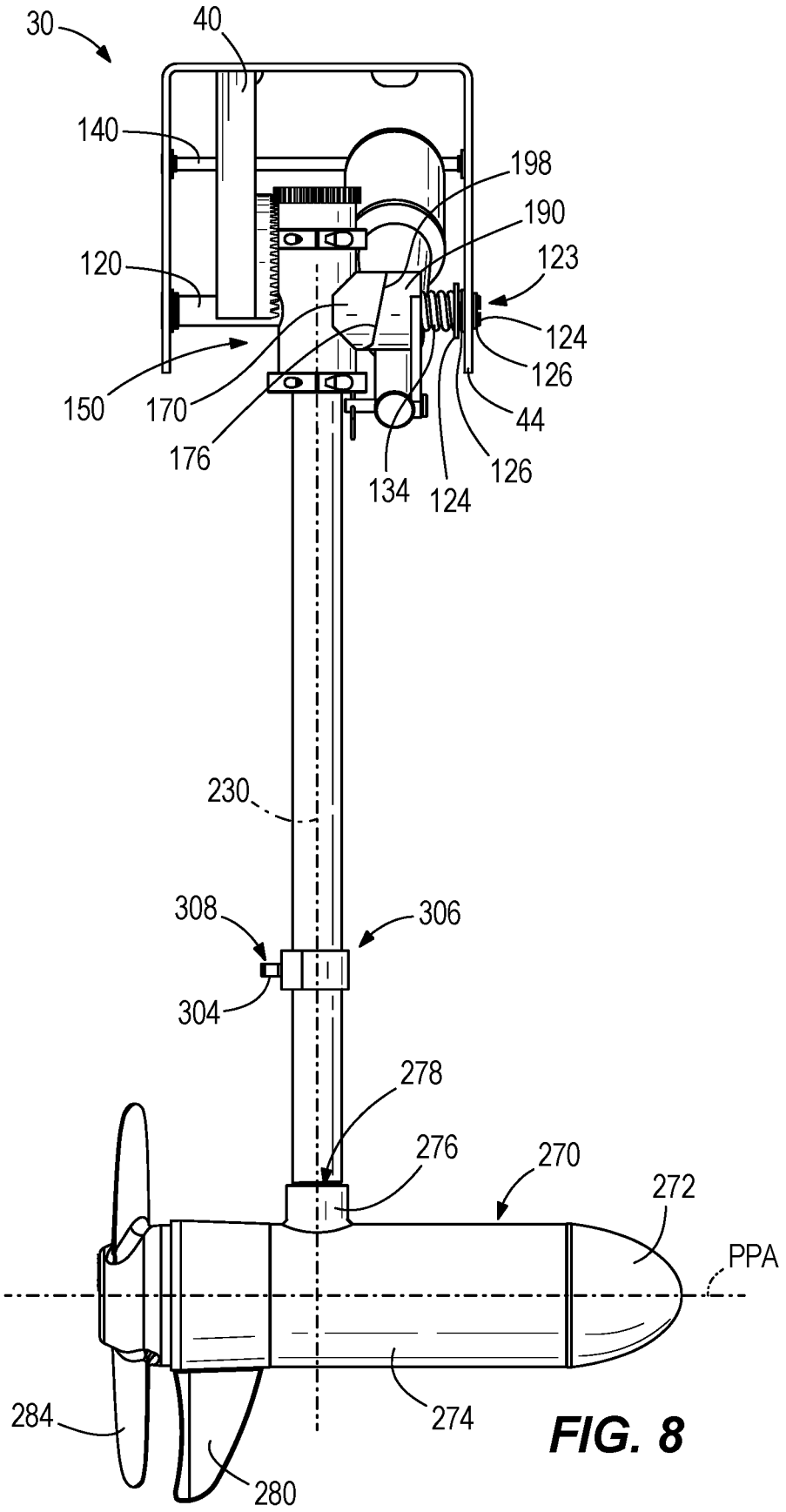
FIG. 8 is a rear view of the propulsion device as shown in FIG. 6.

With reference to FIGS. 2 and 5-6, a pivot rotation device 150 is coupled to the shaft 230 near its proximal end 232, below the moving gear 100. The pivot rotation device 150 includes a main body 152 extending between a first end 154 and a second end 156 with an opening 153 defined therebetween. The shaft 230 is received through the opening 153 between the first end 154 and second end 156 of the main body 152 and rotatable therein. In the embodiment shown, a bushing 155 is received within the opening 153 of the main body 152 and the shaft 230 extends through an opening 157 within the bushing 155. The bushing 155 provides for smooth rotation between the shaft 230 and the main body 152. The shaft 230 is retained within the main body 152 via first and second clamp systems 210, 220. The first clamp system 210 includes two clamp segments 212 coupled together by fasteners 216 received within openings and receivers therein, for example threaded openings for receiving the fasteners 216. The clamp segments 212 are configured to clamp around the shaft 230 just above the main body 152, in the present example with a gasket 213 sandwiched therebetween to provide friction. Likewise, clamp segments 222 of the second clamp system 220 are coupled to each other via fasteners 226 to clamp onto the shaft just below the main body 152, which may also include a gasket sandwiched therebetween. In this manner, the shaft 230 is permitted to rotate within the main body 152, but the first and second clamp systems 210, 220 on opposing ends of the main body 152 prevent the shaft 230 from moving axially through the main body 152.

As shown in FIGS. 2-3 and 5, the shaft 230 is pivotable about a transverse axis (shown as pivot axis PA) formed by coaxially-aligned pivot axles 120, 121. The pivot axles 120, 121 are received within pivot axle openings 52 defined within the sides 44 of the base 40, with bushings 122 therebetween to prevent wear. Snap rings 126 are receivable within grooves 128 defined within the pivot axles 120, 121 to retain the axial position of the pivot axles 120, 121 within the base 40. The interior ends of the pivot axles 120, 121 are received within the main body 152 of the pivot rotation device 150 coupled to the shaft 230. The pivot axle 120 is received within a pivot axle opening 162 of the main body 152 such that the outer surface of the pivot axle 120 engages an interior wall 159 of the main body 152. In the embodiment of FIG. 5, a gap 164 remains at the end of the pivot axle 120 to allow for tolerancing and bending and/or movement of the sides 44 of the base 40.

With continued reference to FIG. 5, the pivot rotation device 150 further includes an extension body 170 that extends away from the main body 152. The extension body 170 defines a pivot axle opening 178 therein for receiving the pivot axle 121. The pivot axle 121 has an insertion end 129 with threads 127 defined thereon, which engage with threads 173 of the pivot axle opening 178 defined in the extension body 170. A slot 123 is defined in the end of the pivot axle 121 opposite the insertion end 129. The pivot axle 121 is therefore threadably received within the extension body 170 by rotating a tool (e.g., a flathead screwdriver) engaged within the slot 123 defined in the end of the pivot axle 121. A snap ring 126 may also be incorporated and receivable within grooves 128 defined in the pivot axle 121 to prevent axial translation of the pivot axle 121 relative to the sides 44 of the base 40.

As shown in FIG. 2, a face 176 of the extension body 170 defines a notch 177 recessed therein, which as will become apparent provides for non-rotational engagement with a pivot arm 190. The pivot arm 190 includes a barrel portion 192 having a face 198 with a protrusion 179 extending perpendicularly away from the face 198. The protrusion 179 is received within the notch 177 when the faces 176, 198 abut each other to rotationally fix the pivot arm 190 and the extension body 170. It should be recognized that other configurations for rotationally fixing the pivot arm 190 and extension body 170 are also contemplated by the present disclosure, for example other keyed arrangements or fasteners.

The barrel portion 192 of the pivot arm 190 further defines a pivot axle opening 199 therethrough, which enables the pivot axle 121 to extend therethrough. The pivot arm 190 further includes an extension 200 that extends away from the barrel portion 192. The extension 200 extends from a proximal end 202 coupled to the barrel portion 192 to distal end 204, having an inward face opposite an outward face 208. A mounting pin opening 209 is defined through the extension 200 near the distal end 204, which as discussed below is used for coupling the pivot arm 190 to an actuator 240.

As shown in FIGS. 2 and 4, the pivot arm 190 is biased into engagement with the main body 152 of the pivot rotation device 150 via a biasing device, such as a spring 134. In the example shown, the spring 134 is a coil or helical spring that engages the outward face 208 of the extension 200 of the pivot arm 190 at one end and engages a washer 124 abutting a snap ring 126 engaged within a groove of the pivot axle 121 at the opposite end. In this manner, the spring 134 provides for a biasing force engaging the pivot arm 190 and the main body 152 such that the faces 176, 198 thereof remain in contact during rotation of the pivot arm 190, but also provides a safeguard. For example, if the shaft 230 experiences an impact force (e.g., a log strike), the presently disclosed configuration allows the protrusion 179 (shown here to have a rounded shape) to exit the notch 177 against the biasing force of the spring 134 to prevent the force from damaging other components, such as the actuator 240 coupled to the pivot arm 190 (discussed further below).

Referring to FIGS. 2-4, the stowable propulsion device 30 further includes an actuator 240 (presently shown is a linear actuator), which for example may be an electric, pneumatic, and/or hydraulic actuator presently known in the art. The actuator 240 extends between a first end 242 and second end 244 and has a stationary portion 246 and an extending member 260 that extends from the stationary portion 246 in a manner known in the art. The stationary portion 246 includes a mounting bracket 248 that is coupled to the base 40 via fasteners 252, such as bolts, for example. At the opposite end of the actuator 240, a mounting pin opening 261 extends through the extending member 260, which is configured to receive a mounting pin 262 therethrough to couple the extending member 260 to the pivot arm 190 of the pivot rotation device 150. The mounting pin 262 shown extends between a head 264 and an insertion end 266, which in the present example has a locking pin opening 268 therein for receiving a locking pin 269. The locking pin 269, for example a cotter pin, is inserted or withdrawn to removably retain the mounting pin 262 in engagement between the actuator 240 and the pivot arm 190. In the embodiment of FIGS. 2-4, it should be recognized that actuation of the actuator 240 thus causes pivoting of the shaft 230 about the pivot axis PA.

Referring to FIG. 2, the stowable propulsion device 30 further includes a propulsor 270 coupled to the distal end 234 of the shaft 230. The propulsor 270 may be of a type known in the art, such as an electric device operable by battery. In the example shown, the propulsor 270 includes a nose cone 272 extending from a main body 274. The main body 274 includes an extension collar 276 that defines a shaft opening 278, whereby the shaft 230 is received within the shaft opening 278 for coupling the shaft 230 to the propulsor 270. The propulsor 270 includes a motor 282 therein, whereby control and electrical power may be provided to the motor 282 by virtue of a wire harness 290 (FIG. 9, also referred to as a wire) extending through the shaft 230, in the present example via the opening 108 defined through the moving gear 100; however, it should be recognized that the wire harness 290 may enter the shaft 230 or propulsor 270 in other locations. In some configurations, the wire harness 290 also extends through a gasket 291 (FIG. 9) that prevents ingress of water or other materials into the shaft 230, for example. The propulsor 270 further includes a fin 280 and is configured to rotate the propeller 284 about a propeller axis PPA. The propulsor 270 extends a length 286 (FIG. 3) and provides propulsive forces in a direction of propulsion DOP. With reference to FIG. 4, the propulsor 270 has a width PW that is perpendicular to the length 286, in certain embodiments the width PW being less than the width 64 of the base 40.

As shown in FIG. 6 and discussed further below, the propulsor 270 is configured to propel the marine vessel 1 through the water in the port-starboard direction PS when the shaft 230 is positioned in the deployed position. It should be recognized that, for simplicity, the propulsor 270 is described as generating propulsion in the port-starboard direction, and thus that the marine vessel moves in the port-starboard direction. However in certain configurations, the propulsor 270 may accomplish this movement of the marine vessel in the port-starboard direction by concurrently using another propulsor coupled elsewhere on the marine vessel 1, for example to provide translation rather than rotation of the marine vessel 1.

It should be recognized that when transitioning the shaft 230 and propulsor 270 from the stowed position of FIG. 3 to the deployed position of FIG. 6, the shaft 230 pivots 90 degrees about the pivot axis PA from being generally horizontal to generally vertical, and the propulsor 270 rotates 90 degrees about the length axis LA of the shaft 230 from the propeller axis PPA being within the fore-aft plane FAP (FIG. 1) to extending in the port-starboard direction PS. The present inventors invented the presently disclosed stowable propulsion devices 30 wherein pivoting of the shaft 230 about the pivot axis PA automatically correspondingly causes rotation of the shaft 230 about is length axis LA without the need for additional actuators (both being accomplished by the same actuator 240 discussed above). With reference to FIGS. 2-3, this function is accomplished through a gearset 90, which as discussed above is formed by the engagement of the stationary gear 92 and moving gear 100.

As discussed above, the stationary gear 92 is fixed relative to the base 40 and the moving gear 100 rotates in conjunction with the shaft 230 rotating about its length axis LA. In this manner, as the shaft 230 is pivoted about the pivot axis PA via actuation of the actuator 240, the engagement between the mesh face 96 of the stationary gear 92 and the mesh face 104 of the moving gear 100 causes the moving gear 100 to rotate, since the stationary gear 92 is fixed in place. This rotation of the moving gear 100 thus causes rotation of the moving gear 100, which correspondingly rotates the shaft 230 about its length axis LA. Therefore, the shaft 230 is automatically rotated about its length axis LA when the actuator 240 pivots the shaft 230 about the pivot axis PA. It should be recognized that by configuring the mesh faces 96, 104 of the gears accordingly (e.g., numbers and sizes of gear teeth), the gearset 90 may be configured such that pivoting the shaft 230 between the stowed position of FIG. 4 and the deployed position of FIG. 6 corresponds to exactly 90 degrees of rotation for the shaft 230 about its length axis LA, whether or not the shaft 230 is configured to pivot 90 degrees between its stowed and deployed positions. It should be recognized that other pivoting and/or rotational angles are also contemplated by the present disclosure.

The present inventors invented the presently disclosed configurations, which advantageously provide for stowable propulsion devices 30 having a minimal width 64 (FIG. 2) when in the stowed position, clearing the way for use of a scissor type lift 20 or other lifting mechanisms for the marine vessel 1, while also positioning the propulsor for generating thrust in the port-starboard direction PS when in the deployed position.

As shown in FIG. 6, certain embodiments include stop 80 within the base 40 for stopping, centering, and/or securing the shaft 230 in the stowed position. In the embodiment shown, a centering slot 86 is defined within the bottom 84 of the stop 80. This centering slot 86 is configured to receive a tab 308 that extends from a clamp 306 positioned approximately at a midpoint along the shaft 230. When the shaft 230 is pivoted and rotated into its stowed position as shown in FIG. 2, the tab 308 of the clamp 306 is received within the centering slot 86 of the stop 80, whereby the bottom 84 of the stop 80 itself prevents further upward pivoting of the shaft 230, and whereby the centering slot 86 prevents lateral movement of the propulsor 270 when in the stowed position.

The embodiment of FIG. 6 further depicts a positional sensor 300 configured for detecting whether the stowable propulsion device 30 is in the stowed position. The positional sensor 300 shown includes a stationary portion 302 and a moving portion 304, whereby the stationary portion 302 is a Hall Effect Sensor positioned adjacent to the centering slot 86 of the stop 80, which detects the moving portion 304 integrated within the tab 308. In this manner, the positional sensor 300 detects when the shaft 230 is properly in the stowed position, and when it is not.

It should be recognized that other positional sensors 300 are also known in the art and may be incorporated within the systems presently disclosed. For example, FIG. 3 depicts an embodiment in which the positional sensor 300 is incorporated within the actuator 240, such as a linear encoder, that can be used to infer the position of the shaft 230 via the position of the extending member 260 of the actuator 240 relative to the stationary portion 246. An exemplary positional sensor 300 is Mercury Marine's Position Sensor ASM, part number 8M0168637, for example.

Figure 9:
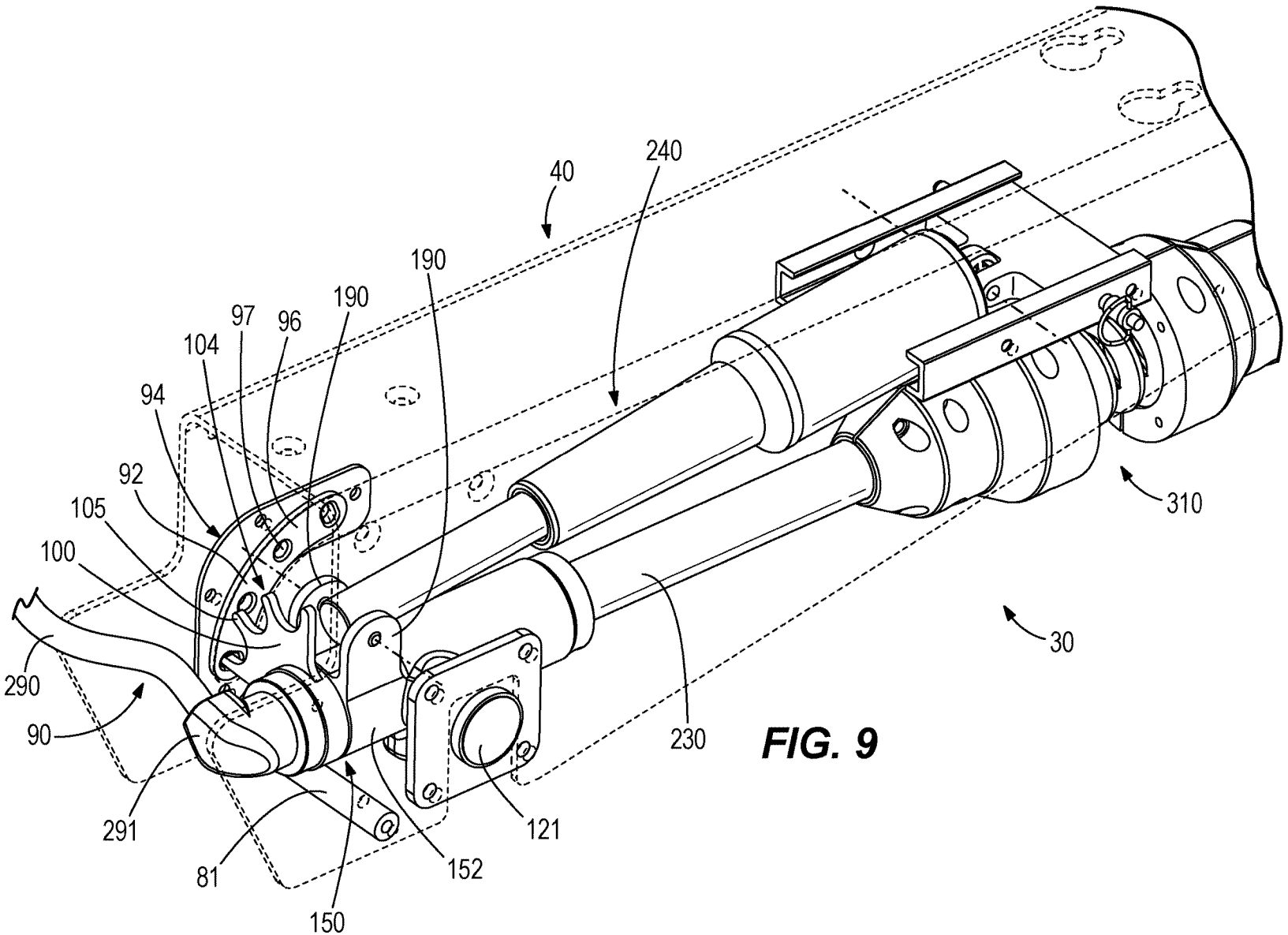
FIG. 9 is an isometric view of an alternate embodiment of propulsion device coupled to a marine vessel and having a propulsor.

The present disclosure contemplates other embodiments of stowable propulsion devices 30. For example, FIG. 9 depicts an embodiment having two pivot arms 190 coupled directly to the main body 152 of the pivot rotation device 150. The actuator 240 is pivotally coupled to the two pivot arms 190 in a similar manner as that discussed above. In certain examples, the two pivot arms 190 are integrally formed with the clamp segments 212 of the first clamp system 210, for example. The gearset 90 of the embodiment in FIG. 9 also varies from that discussed above. Specifically, the mesh face 96 of the stationary gear 92 includes openings 97 rather than gear teeth. These openings 97 are configured to receive fingers 105 that extend from the mesh face 104 of the moving gear 100, generally forming a gear and sprocket type system for the gearset 90. The embodiment shown also includes a stop rod 81 for preventing the shaft 230 from rotating too far, or in other words past the deployed position.

Figure 10:
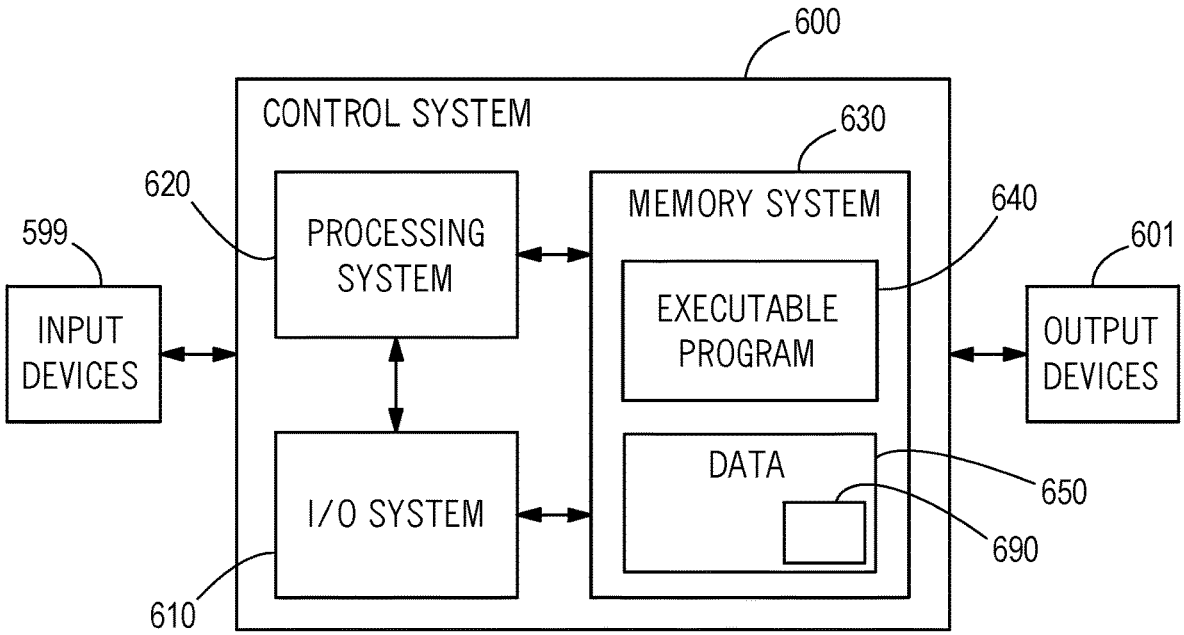
FIG. 10 depicts an exemplary control system for controlling propulsion devices according to the present disclosure.

FIG. 10 depicts an exemplary control system 600 for operating and controlling the stowable propulsion device 30. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 600 communicates with each of the one or more components of the stowable propulsion device 30 via a communication link CL, which can be any wired or wireless link. The control system 600 is capable of receiving information and/or controlling one or more operational characteristics of the stowable propulsion device 30 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the stowable propulsion device 30. Moreover, the communication link CL lines are meant only to demonstrate that the various control elements are capable of communicating with one another, and do not represent actual wiring connections between the various elements, nor do they represent the only paths of communication between the elements. Additionally, the stowable propulsion device 30 may incorporate various types of communication devices and systems, and thus the illustrated communication links CL may in fact represent various different types of wireless and/or wired data communication systems.

The control system 600 of FIG. 10 may be a computing system that includes a processing system 610, memory system 620, and input/output (I/O) system 630 for communicating with other devices, such as input devices 599 and output devices 601, either of which may also or alternatively be stored in a cloud 602. The processing system 610 loads and executes an executable program 622 from the memory system 620, accesses data 624 stored within the memory system 620, and directs the stowable propulsion device 30 to operate as described in further detail below.

The processing system 610 may be implemented as a single microprocessor or other circuitry, or be distributed across multiple processing devices or sub-systems that cooperate to execute the executable program 622 from the memory system 620. Non-limiting examples of the processing system include general purpose central processing units, application specific processors, and logic devices.

The memory system 620 may comprise any storage media readable by the processing system 610 and capable of storing the executable program 622 and/or data 624. The memory system 620 may be implemented as a single storage device, or be distributed across multiple storage devices or sub-systems that cooperate to store computer readable instructions, data structures, program modules, or other data. The memory system 620 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

The present disclosure further relates to propulsion devices and methods for making propulsion devices that provide for alignment of propeller blades for stowable propulsion devices such as those discussed above. For example, the propulsion devices 30 of FIGS. 2 and 3 provide for rotating the propulsor 270 to be as narrow as possible when in the stowed position. Moreover, this propulsion device 30 is receivable at least partially inside the mounting base 40, specifically between the sides 44 and above the bottom 45 thereof. The portion receivable inside the mounting base 40 may be limited to a portion of the propeller 284, or also include a portion of the main body 274 for the propulsor 270.

However, the present inventors have recognized that the propulsor 270 being receivable at least partially within the mounting base 40 depends upon the blades 287 of the propeller 284 being aligned within the width 64 of the mounting base 40. Moreover, the present inventors have recognized that failure to align the propeller 284 before pivoting the propulsor 270 into the stowed position may not only prevent the propulsor 270 from fully pivoting into this stowed position, but may also damage the propeller 284 and/or other components of the propulsion device 30, such as the actuator 240. As such, the present inventors have identified that it would be advantageous to automatically align the propeller 284 within the mounting base 40 as the propulsor 270 pivots into the stowed position.

Figure 11:
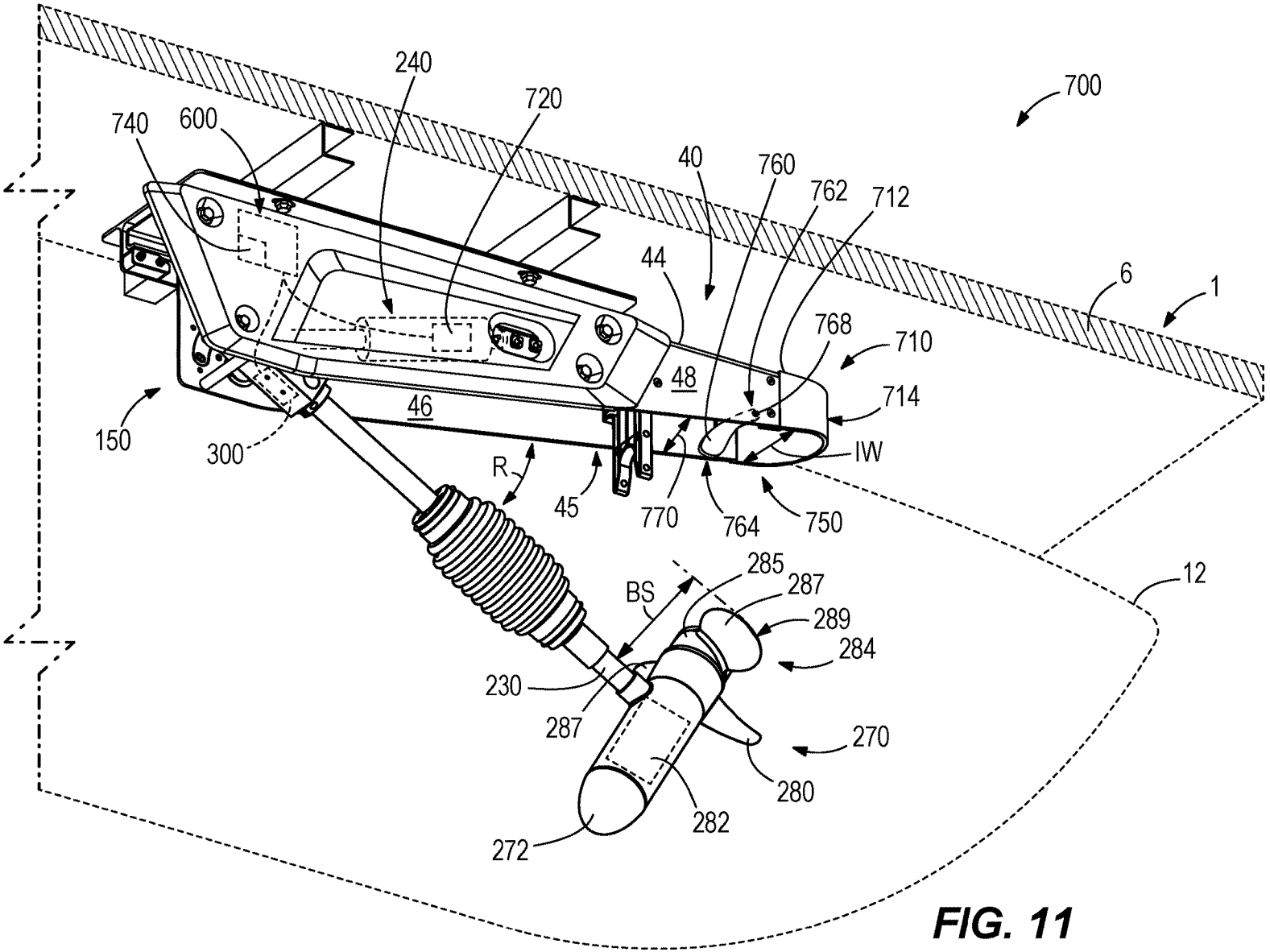
FIG. 11 depicts an isometric bottom-right view of a propulsion device with one embodiment of alignment device for aligning blades of a propulsor within a mounting base according to the present disclosure.
Figure 12:
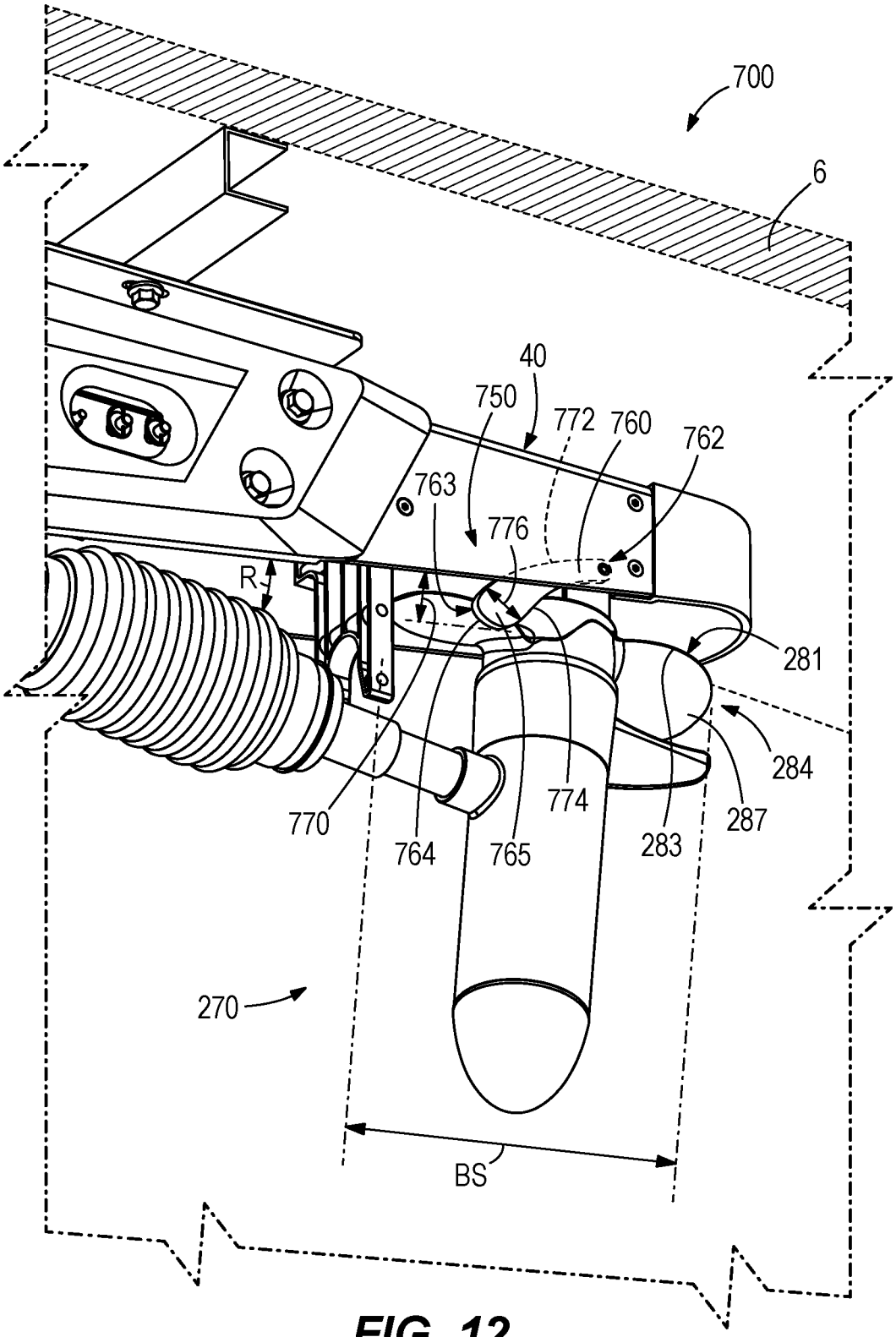
FIG. 12 is close-up of the device of FIG. 11 with the propulsor pivoted further toward the stowed position and the blades now aligned.

FIGS. 11 and 12 show a first example of a propulsion device 700 providing automatic alignment of the propeller 284 as its propulsor 270 pivots into the stowed position within the mounting base 40. As discussed above, the mounting base 40 is coupled to the deck 6 of the marine vessel 1 and has sides 44 extending downwardly there from. The sides 44 include an inward side 44 and outward side 48, with an inner width IW defined between the inward sides 46. The sides 44 terminate at a bottom 45. An end cap 710 is coupled to the mounting base 40 at mounting ends 712 and extends forwardly to a forward end 714. The end cap 710 protects the propeller 284 from damage when in the stowed position, for example when navigating the marine vessel 1 onto the bunks 22 of a scissor type lift 20.

The propulsion device 700 incorporates a pivot rotation device 150 such as that described above, which rotates the propulsor 270 about the shaft 230 as the shaft 230 is pivoted (here by the actuator 240) between deployed and stowed positions. The propulsor 270 includes a propeller 284 having a hub 285 with blades 287 extending radially outwardly therefrom. The blades 287 have tips 289 at the points radially farthest from the hub 285. A blade span BS thereby extends between the tips 289 of the two opposing blades 287. The propeller 284 and particularly its blades 287 also have contoured blade faces 281 extending between edges 283, whereby the blades 287 are configured to propel the marine vessel 1 in water when rotated in a conventional manner.

The propulsion device 700 of FIG. 11 further includes a position sensor 300, in this example a rotational sensor incorporated within the pivot rotation device 150, which measures the angular position of the shaft 230 (and thus the propulsor 270) while pivoting between the deployed and stowed positions. A current sensor 720 is also provided, here integrated within the actuator 240, which measures an amount of electrical current drawn by the actuator 240 during operation thereof. The current sensor 720 and position sensor 300 are each operatively coupled to a control system 600 such as that previously discussed. The control system 600 may further include a timer 740 therein, which is discussed further below.

The propulsion device 700 of FIG. 11 incorporates an alignment device 750 for automatically aligning the blades 287 of the propeller 284 between the sides 44 of the mounting base 40 as the propulsor 270 pivots toward the stowed position. The alignment device 750 is particularly an arm 760 that extends between a first end 762 and second end 764. As shown in FIG. 12, the arm 760 has an inside 763 and outside 765, as well as an upper edge 772 and a lower edge 774 with a height 776 defined therebetween. In the example shown, the height 776 progressively increases from the first end 762 to the second end 764; however, other configurations are also contemplated by the present disclosure (such as arcs having a constant height 776 or configurations having a smallest height 776 at a midpoint between the first end 762 and second end 764, for example). The first end 762 is pivotally coupled to the mounting base 40 via fasteners 768, which may be pins, rivets, nuts and bolts, and/or the like. The second end 764 is therefore moveable relative to the bottom 45 of the mounting base 40 with a second distance 770 defining a distance therebetween. Exemplary materials for the arm 760 include plastics, rubber, aluminum, or other materials known in the art.

In certain examples, the arm 760 also varies in width between the inside 763 and outside 765. For example, the width may progressively increase between the first end 762 and second end 764.

Figure 13:
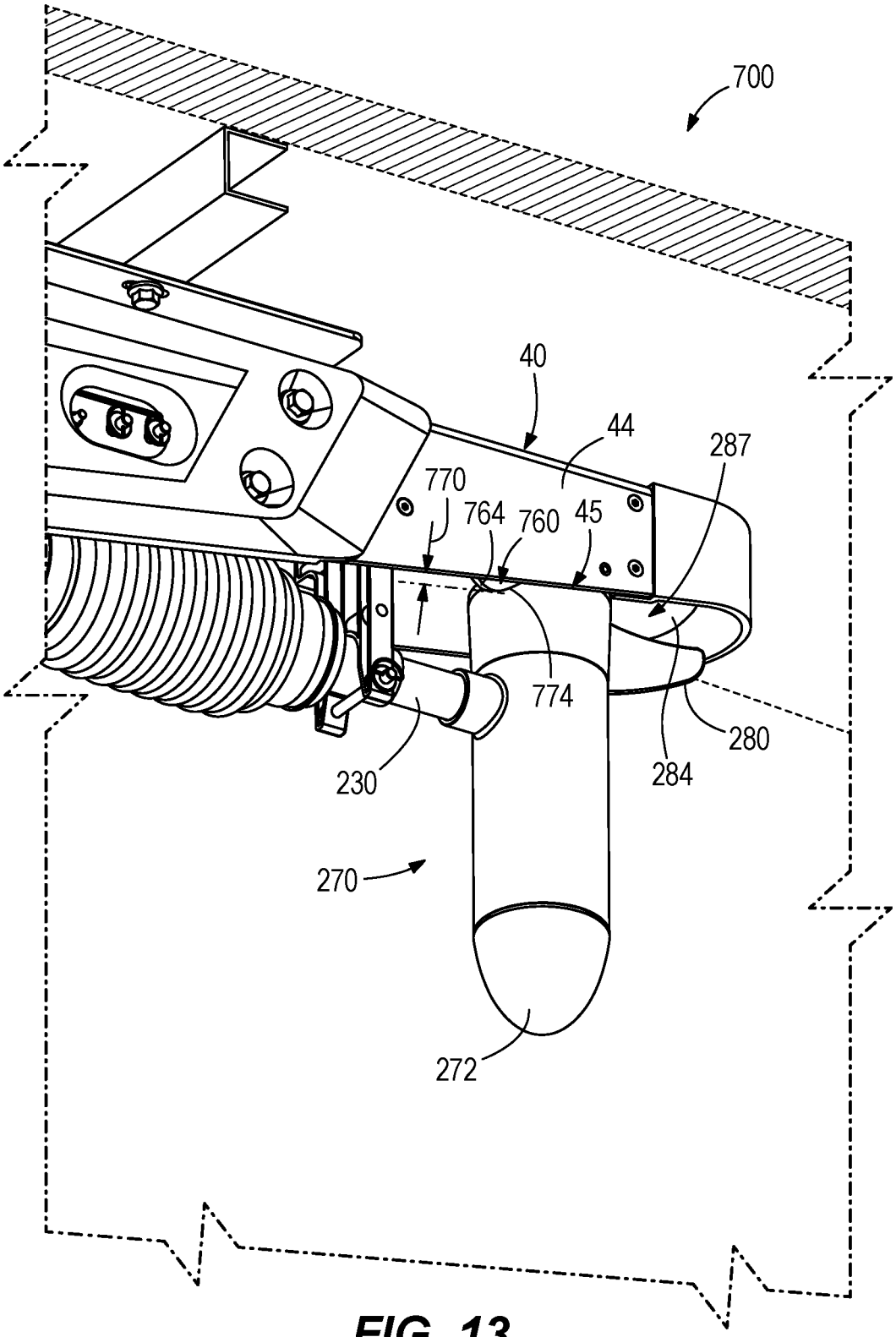
FIG. 13 shows the device of FIG. 12 with the propulsor in the stowed position.

FIGS. 11-13 depict the propulsor 270 pivoting progressively toward the stowed position, being fully stowed in FIG. 13. As the propulsor 270 pivots toward the stowed position, the arm 760 engages one of the blades 287, initially at the second end 764 of the arm 760. This contact may occur while the propeller 284 is stationary, or rotating. If the propeller 284 is not aligned within the mounting base 40, the position of the arm 760 on the inside of one of the sides 44 is such that the mass of the arm 760 acting on the curvature of the blade face 281 causes the propeller 284 to rotate until the second end 764 of the arm 760 drops off the blade 287 (the blade 287 thereby being aligned within the mounting base 40. If the propeller 284 were rotating while the propulsor 270 is pivoting upwardly, engagement may occur between the edge 283 of the blade 287 and the inside 763 of the arm 760, thereby stopping the rotation. In each case, engagement between the arm 760 and the propeller 284 thereby causes and maintains alignment of the blade span BS within the sides 44 of the mounting base 40.

As discussed above, the propulsion device 700 further includes a position sensor 300 and current sensor 720. In certain examples, the control system 600 causes the propeller 284 to rotate as the propulsor 270 pivots toward the stowed position. Rotation of the propeller 284 may be particularly controlled via measurements from the position sensor 300, for example starting rotation of the propeller 284 after the shaft 230 has been pivoted to be a first angle R from being stowed (see FIG. 11), and discontinuing rotation at a second angle R as shown in FIG. 12. This prevents unnecessary rotation of the propeller 284 when the arm 760 is not in close proximity thereto, and thus cannot yet provide alignment of the propeller 284 within the mounting base 40.

Figure 23:
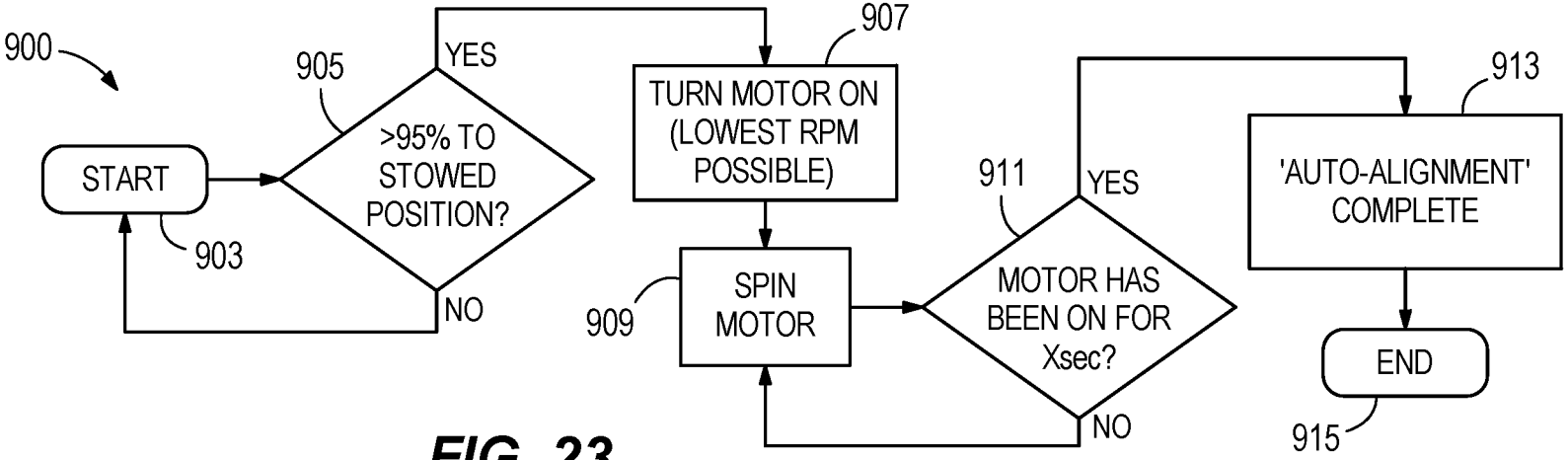
FIG. 23 is a process flow diagram of one method for aligning blades of a propulsor according to the present disclosure.

FIG. 23 shows an exemplary process 900 for controlling the propulsion device 700 using a position sensor 300. Step 903 begins with pivoting the shaft 230 towards the stowed position without rotating the propeller 284. Once the shaft 230 is determined to be 95% of the way towards the stowed position, for example, step 905 provides for operating the motor 282 at the lowest possible RPM in step 907. A timer 740 is also started in the control system 600 when the motor 282 begins rotating. The motor 282 continues rotating in step 909 until the timer 740 is determined in step 911 to exceed a predetermined threshold XA (e.g., 2 seconds, 1 second, or 200 ms, depending on the rotational speed) corresponding to the propeller 284 being aligned within the mounting base 40. For example, it may be empirically determined that once the shaft 230 is 95% of the way to pivoting in the stowed position, rotating the propeller 284 at a given rotation for 1 second corresponds to alignment with the mounting base 40 (steps 913 and 915). Use of the timer 740 may also be advantageous in the context of also or alternatively using a propeller position sensor 730 (discussed further below), which provides insight as to a starting point for the rotation of the propeller 284 before rotating for a given time. For example, it may be determined that when the propeller position sensor 730 indicates alignment of the propeller 284 as it rotates, an additional 1 second of rotation will return the propeller 284 to alignment again.

In addition or in the alternative, the current sensor 720 may be provided as an input to the control system 600 rotating the propeller 284 as the propulsor 270 pivots to the stowed position. For example, an increase in the current drawn by the motor 282 occurs when the arm 760 stops the propeller 284 from rotating, which can be detected by the current sensor 720. This increased current is detected by the control system 600, which then stops supplying electricity to the motor 282 to prevent damage to the motor 282, propeller 284, and/or arm 760. In particular, the control system 600 determines when to discontinue rotating the motor 282 by comparing the current measured by the current sensor 720 to a predetermined threshold XA (e.g., 0.1 A, 0.3 A, 0.5 A, 1 A, or others, depending on the hardware being used) corresponding to the arm 760 resisting rotation of the propeller 284.

Figure 24:
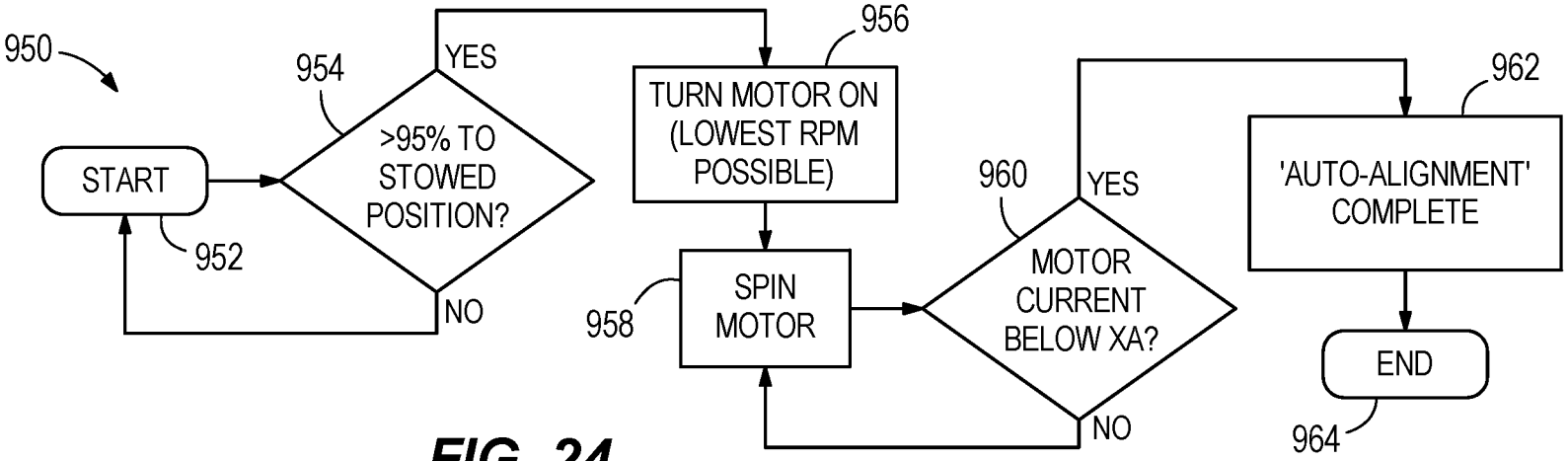
FIG. 24 is a process flow diagram of another method for aligning blades of a propulsor according to the present disclosure.

An exemplary process 950 for using the current sensor 720 is shown in FIG. 24, which may mirror that of FIG. 23 but for the step 960 comparison of the current drawn from the motor 282 as determined by the current sensor 720 to a predetermined threshold XA. In this example, the current exceeds the predetermined threshold XA when the propeller 284 is prevented from further rotation, thereby indicating that the automatic alignment process has completed.

Figure 25:
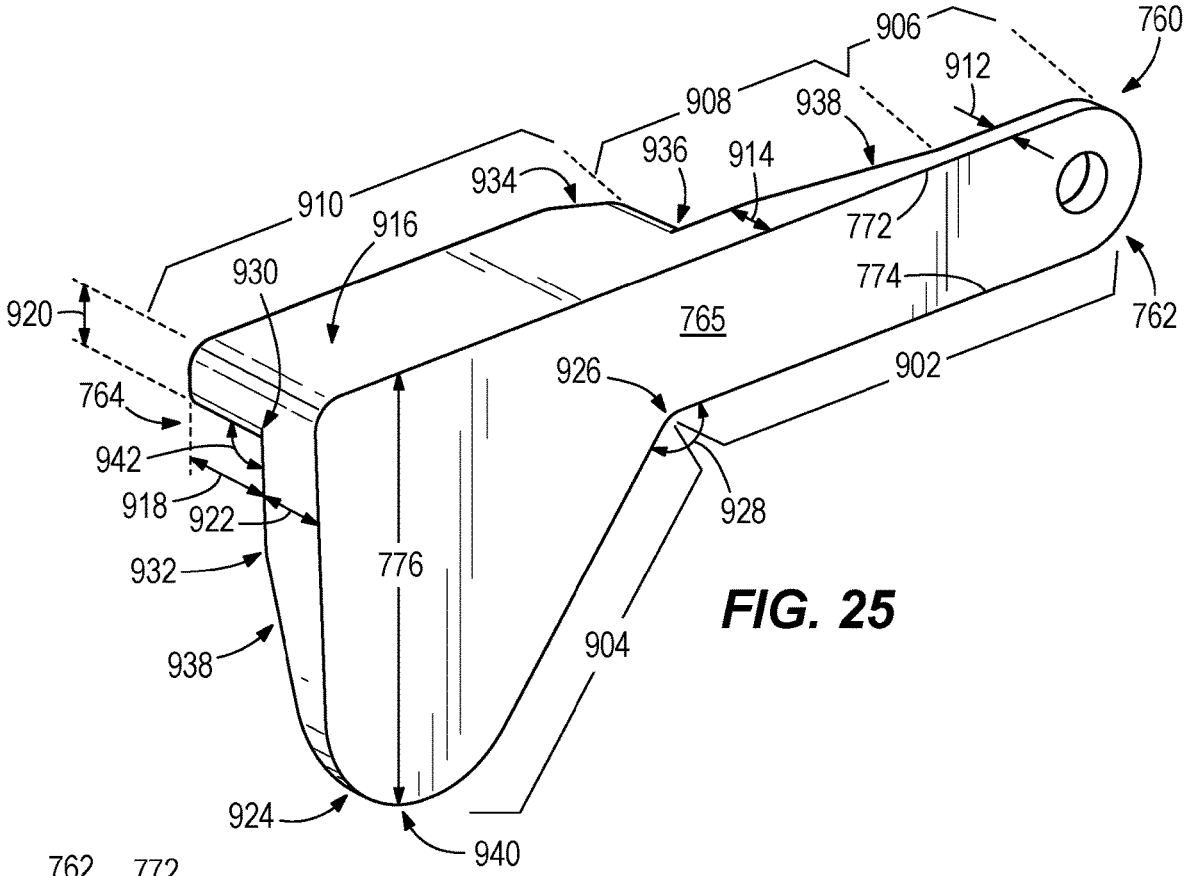
FIG. 25 is an isometric right view of another arm for aligning blades of a propulsor according to the present disclosure.
Figure 26:
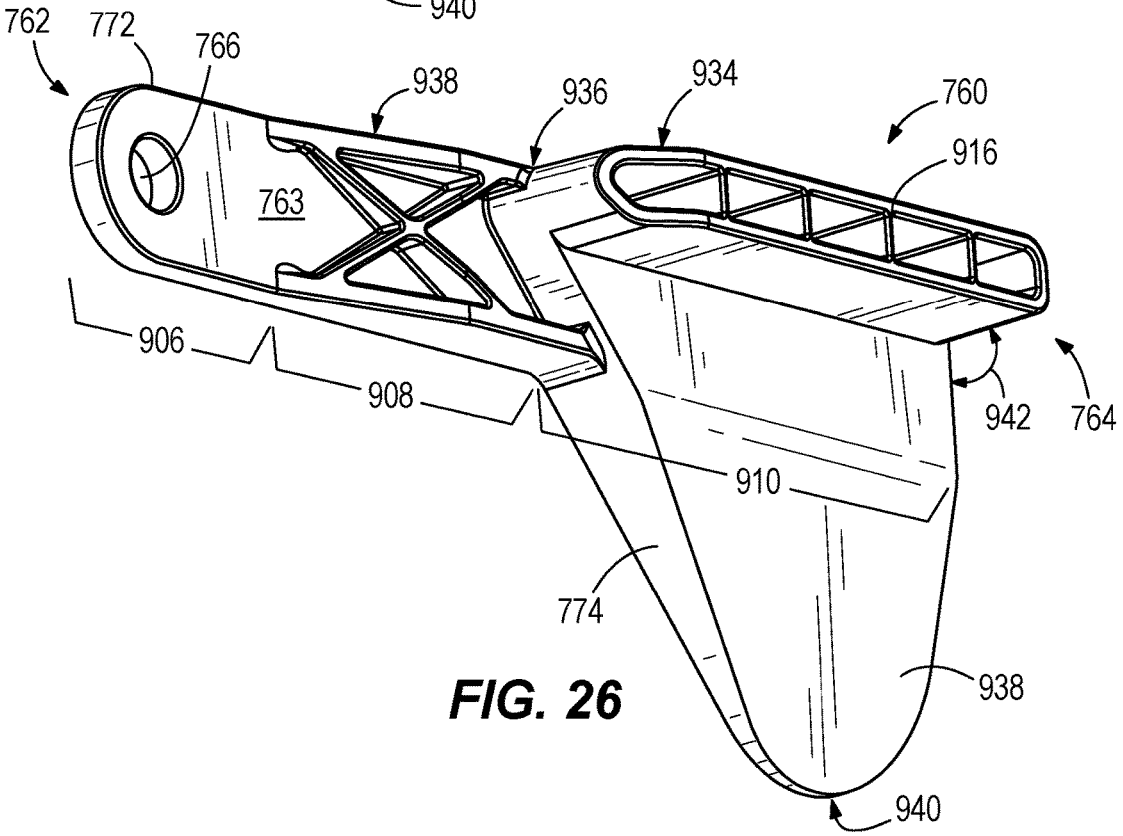
FIG. 26 is an isometric left view of the arm of FIG. 25.

FIGS. 25 and 26 depict another embodiment of an arm 760, which may be incorporated into the alignment device 750 of FIG. 11, for example. The arm 760 extends from a first end 762 to a second end 764 and has an inside 763 and an outside 765, as discussed above. An opening 766 extends through the arm 760 near the first end 762, which receives a fastener therethrough to pivotally couple the arm 760 to the base 40 (FIG. 11). As shown in FIG. 25, the arm 760 extends from an upper edge 772 and a lower edge 774 defining a varying height 776 therebetween. From the outside 765, the height 776 generally has a first section 902 that is relatively constant, which then increases in a generally linear manner after a point 926 in a second section 904 until a bottom 940. The present inventors have identified that an angle 928 between the first section 902 and the second section 904 is advantageous for allowing the propeller to pivot the arm 760 upwardly (into the base 40, see FIG. 11) if the arm 760 does not contact the propeller in the right position, allowing the next blade of the propeller to be caught instead. In the example shown, the angle 928 is approximately 45 degrees; however, other ranges of angles are also contemplated by the present disclosure, including between 40-50 degrees, 30-60 degrees, and 20-70 degrees, for example.

With continued reference to FIGS. 25-26, the contour of the lower edge 774 has a generally rounded shape 924 at the bottom 940, which the present inventors have identified to be advantageous in that if the bottom 940 catches the propeller in the middle of the blade, the rounded contour allows the propeller to slide past to catch the next blade.

Likewise, a thickness 922 between the inside 763 and the outside 765 varies between the upper edge 772 and the lower edge 774. The thickness 922 is greatest at a shelf 916 that extends away from the inside surface 763 by a distance 918 (here at an angle 942 of 90 degrees, though other angles are contemplated by the present disclosure). The thickness 922 then decreases in a generally linear manner after a point 932 until reaching a minimum thickness 922 near the bottom 940. The area 938 formed by this decreasing thickness 922 is where the propeller blade contacts the arm 760 to slowly stop the propeller from rotating and gently ease the propeller into position aligned with the base. In certain examples, the area 938 is generally flat and at a 30-60 degree angle to the outside 765 (e.g., 45 degrees), but other angles are also contemplated by the present disclosure.

With continued reference to FIGS. 25-26, a length of the arm 760 between the first end 762 and second end 764 is divided into a first section 906 where the opening 766 is located, a second section 910 where the shelf 916 is located, and a third section 908 that transitions therebetween. In the example shown, the third section 908 begins with a thickness 914 that is less than the distance 918 of the shelf 916, but that then decreases generally linearly after a point 936 to a minimum thickness 912 near the opening 766. This design, and the third section 908 in particular, includes ribs and/or lattice structures to ensure strength for the arm 760 between the first section 906 and second section 910.

The shelf 916 is configured to be lifted by the blade of the propeller (when the propeller is properly aligned) as the shaft pivots towards the stowed position. In other words, the arm 760 is lifted at least partially into the base 40 (FIG. 11) via the shelf 916 by the propeller. In certain examples, the shelf 914 has a transition 934 from the point 936 where the third section 908 meets the second section 910 to the full distance 918 of the shelf 916, which helps position the propeller and avoid sharp corners for the arm 760. The present inventors have recognized that the length of the second section 910 must be long enough that the shelf 916 does not fall off the blade of the propeller, which would allow the arm 760 to pivot downwardly out of the base 40 when the propulsor is stowed. In certain examples, the length of the second section 910 is approximately half of the length of the first section 906 and third section 908 combined (though other ranges such as 40%, or anything greater than 0%, are also contemplated by the present disclosure).

Figure 14:
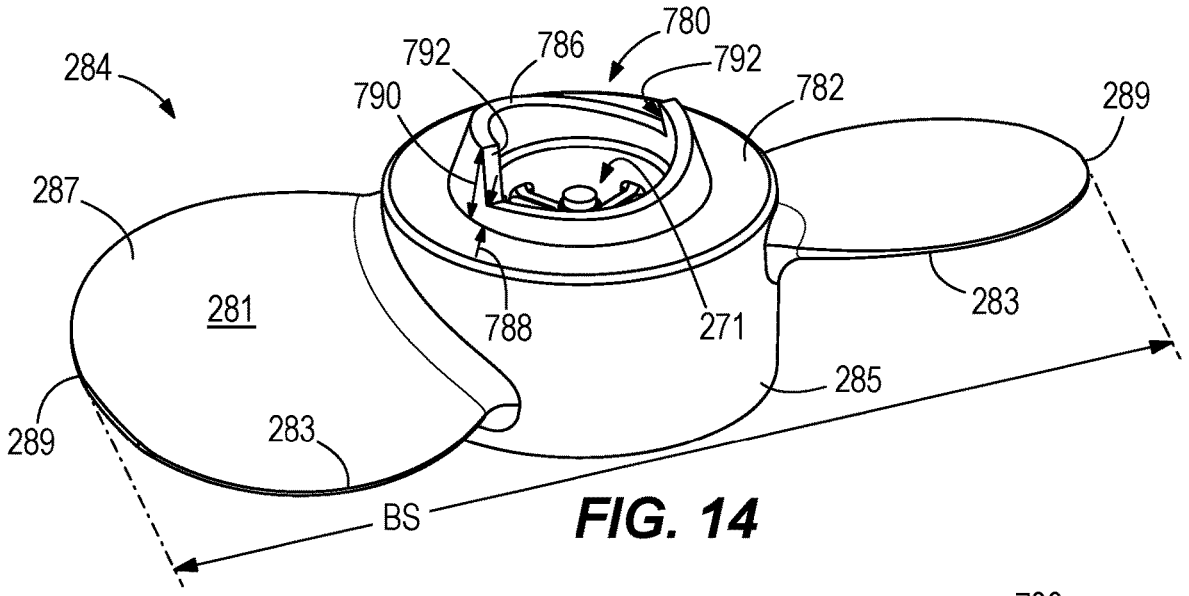
FIG. 14 is an isometric view of a propeller for another embodiment alignment device according to the present disclosure.
Figure 15:
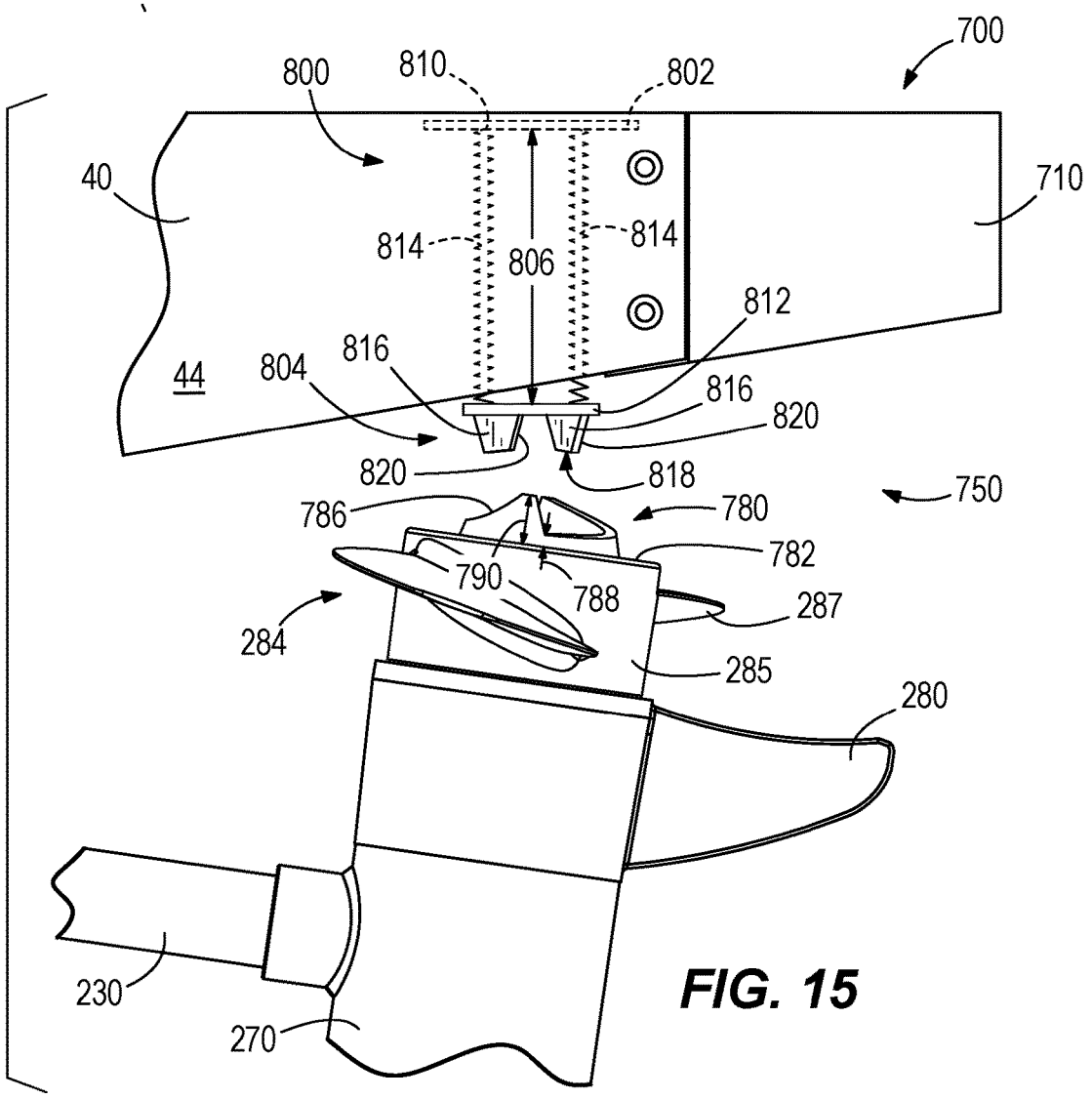
FIGS. 15-16 are side views of an embodiment of alignment device incorporating the propeller of FIG. 14 showing the propulsor progressively pivoting toward the stowed position.
Figure 16:
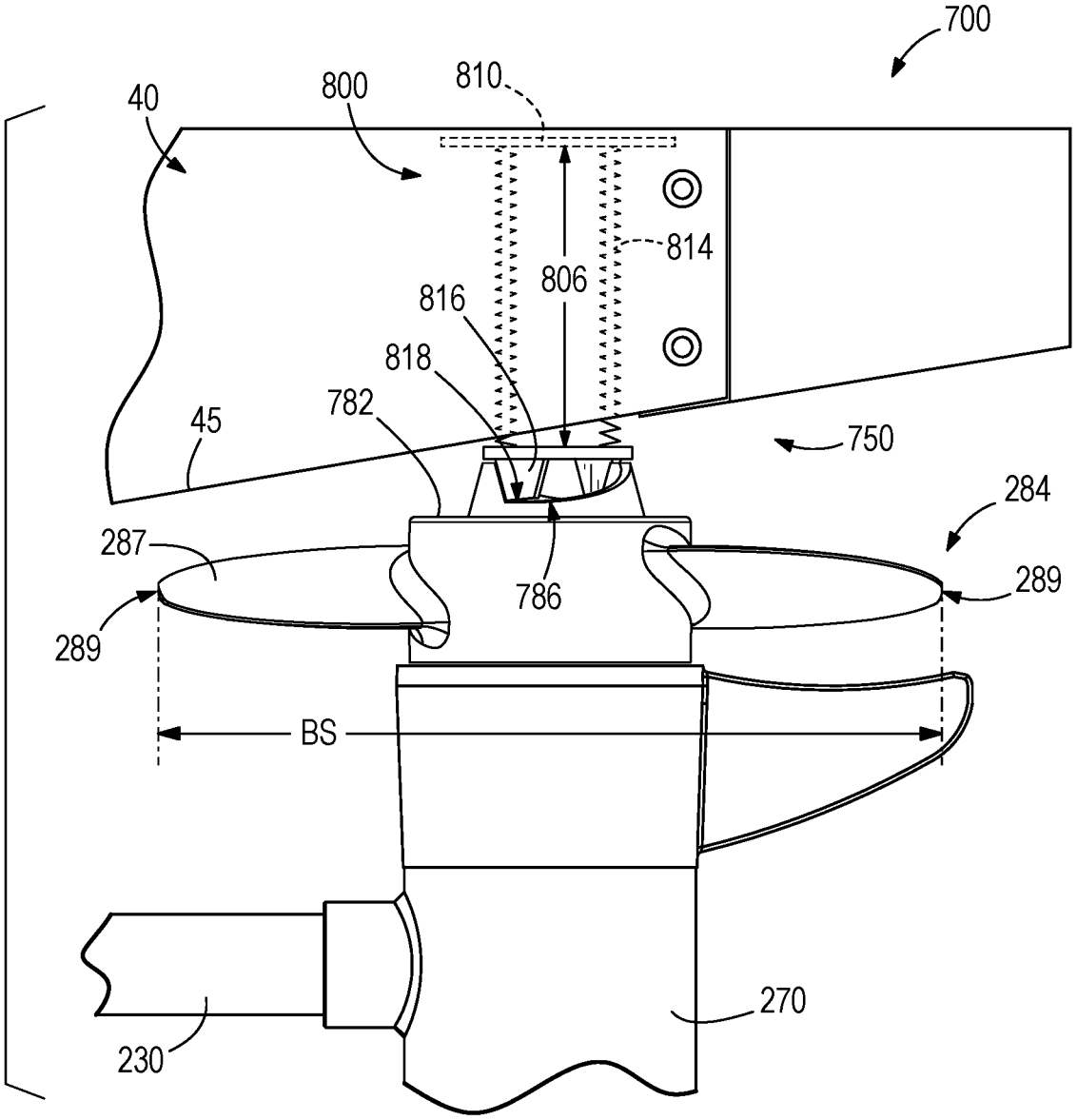

FIGS. 14-16 depict another example of alignment device 750 for aligning a propeller 284 within a mounting base 40. This alignment device 750 functions similarly to the alignment device 750 of FIGS. 11-13, but now engages the propeller 284 near its hub 285 rather than engaging the blades 287. As shown in FIG. 14, an opening is provided through a face 782 of the hub 285, through which the propeller 284 is coupled to the motor 282 via fastening hardware 271 as conventionally known in the art. A hub ramp 780 extends away from the face 782 of the hub 285. The hub ramp 780 has an aligning face 786 that rises from a lower height 788 above the face 782 to an upper height 790 above the face 782 (here between two lower heights 788 and two upper heights 790 in one rotation of the propeller 284). A stop wall 792 is defined between an upper height 790 and the lower height 788 adjacent thereto, which again increases to an upper height 790 in a ramped manner.

As shown in FIG. 15, a guide 800 is coupled to the mounting base 40 and engages with the ramp hub 780 to align the propeller 284 (and/or stop rotation when aligned) within the mounting base 40 similar to the arm 760 and current sensor 720 described above. The guide 800 has a first end 802 and second end 804, the second end 804 having a distance 806 from the first end 802. The guide 800 has a base 810 coupled to the mounting base 40, as well as a member 812 near the second end 804 that is resiliently coupled to the base 810 via resilient members, for example springs 814. Fingers 816 extend downwardly from the member 812 to tips 818, which in the present example have inwardly tapering sides 820 going down to the tips 818. The fingers 816 are configured to engage with the hub ramp 780 of the propeller 284.

FIG. 15 shows the guide 800 in a neutral position with the propeller 284 not aligned within the mounting base 40. The guide 800 is non-rotatable relative to the mounting base 40. As the propulsor 270 continues to pivot upwardly toward the stowed position, the fingers 816 and particularly the tips 818 thereof contact the aligning face 786 of the hub ramp 780, here with the tips 818 contacting the aligning face 786 substantially near the upper height 790. As the propulsor 270 continues to pivot upwardly, the engagement between the fingers 816 and hub ramp 780 cause the propeller 284 to rotate such that the fingers 816 slide along the aligning face 786 of the hub ramp 780 toward the lower heights 788 thereof, which are configured to coincide with the propeller 284 being aligned within the mounting base 40. As shown in FIG. 16, the rotation of the propeller 284 by the guide 800 stops when the fingers 816 contact the stop walls 792 of the hub ramp 780. Specifically, the stop walls 792 are substantially steep such that the fingers 716 do not jump upwardly from the aligning face 786 to permit further rotation of the propeller 284.

In the example shown in FIG. 16, further pivoting of the propulsor 270 upwardly no longer causes rotation of the propeller 284, but now causes compression of the springs 814 coupling the fingers 816 coupled to the member 812 to the base 810 of the guide 800. This provides that the propeller 284 is aligned within the mounting base 40 before the propeller 284 could potentially contact the bottom 45 of the sides 44 of the mounting base 40. This further provides that, once aligned, the propeller 284 is maintained in alignment while the propulsor 270 is permitted to be further retracted within the mounting base 40 through compression of the springs 814.

Figure 18:
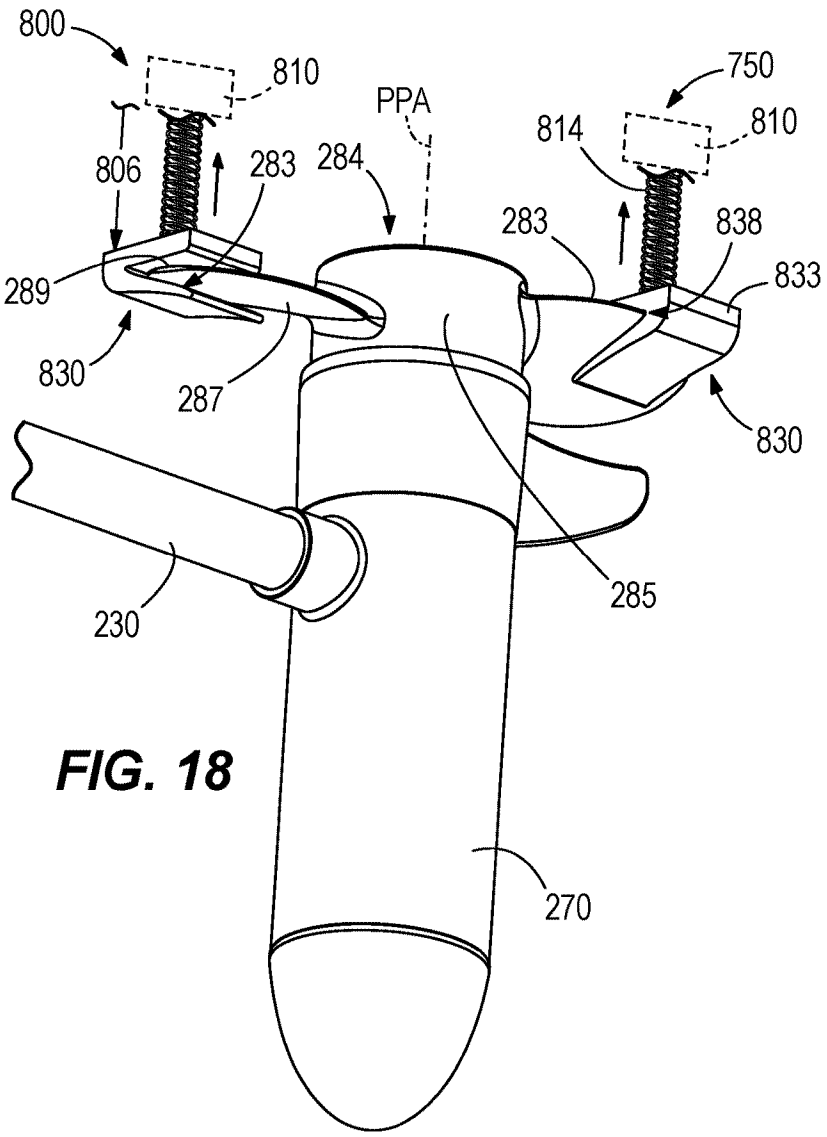
FIGS. 17-18 are isometric views of another embodiment of alignment device before and after aligning the blades according to the present disclosure, respectively.
Figure 17:
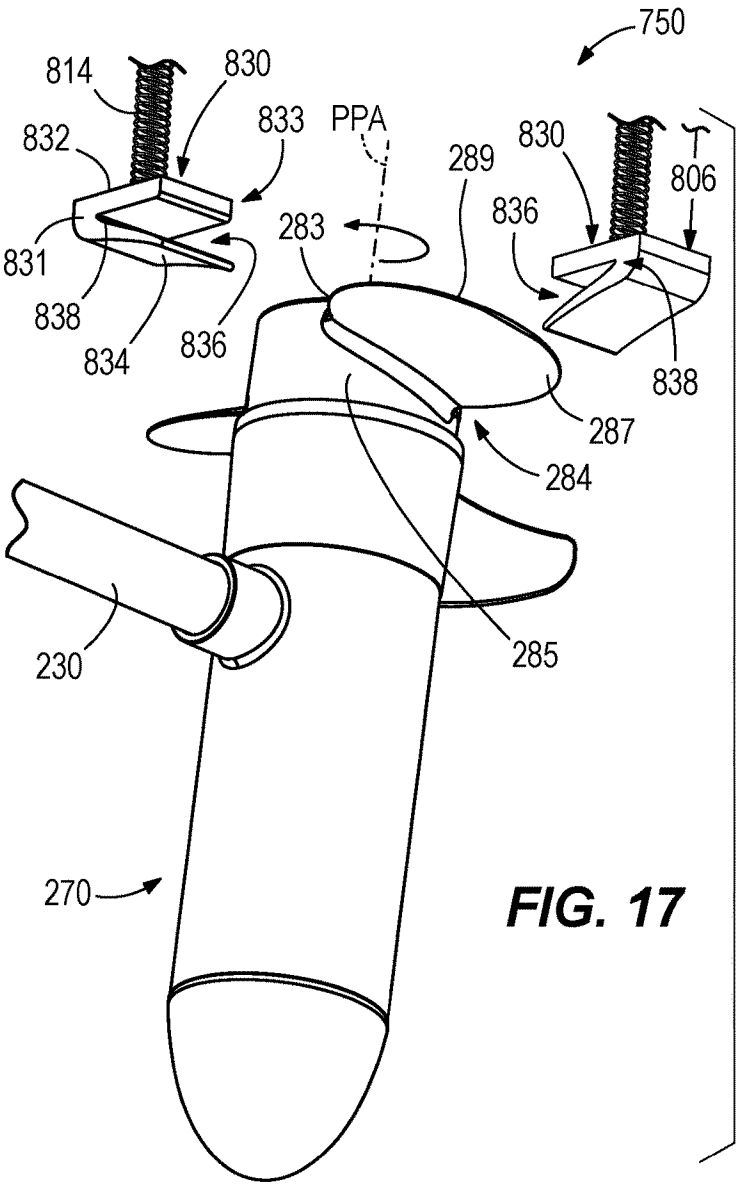

FIGS. 17 and 18 depict another example of an alignment device 750 according to the present disclosure. In this example, the alignment device 750 includes a guide 800 having similarity to that described for FIGS. 15 and 16, but wherein the member 812 and finger 816 are replaced with blade catchers 830. Each of the blade catchers 830 extends from a first end 831 to a second end 833, and a top 832 to a bottom 834. An opening 836 is provided in each second end 833, which extends inwardly to a backstop 838. In the present example, the opening 836 converges in a "V" shape such that the backstop 838 has a shorter height (in the top 832 and bottom 834 direction) than the opening 836 at the second end 833.

The blade catchers 830 are shaped to engage with the blades 287 of the propeller 284 as the propeller 284 rotates, specifically with the edges 283 of the blades 287 being caught within the openings 836. The propeller 284 rotates while the propulsor 270 pivots toward the stowed position until the blades 287 are captured and retained within the openings 236 of the blade catchers 238, thereby ceasing rotation of the propeller 284 (e.g., through use of the current sensor 720 discussed above). Further pivoting of the propulsor 270 toward the stowed position after the blades 287 are retained within the blade catchers 830 is permitted by the blade catchers 830 being coupled to the guide 800 via springs 814, which compress until the propulsor 270 finally reaches the stowed position (similar to the example of FIGS. 15-16).

Figure 19:
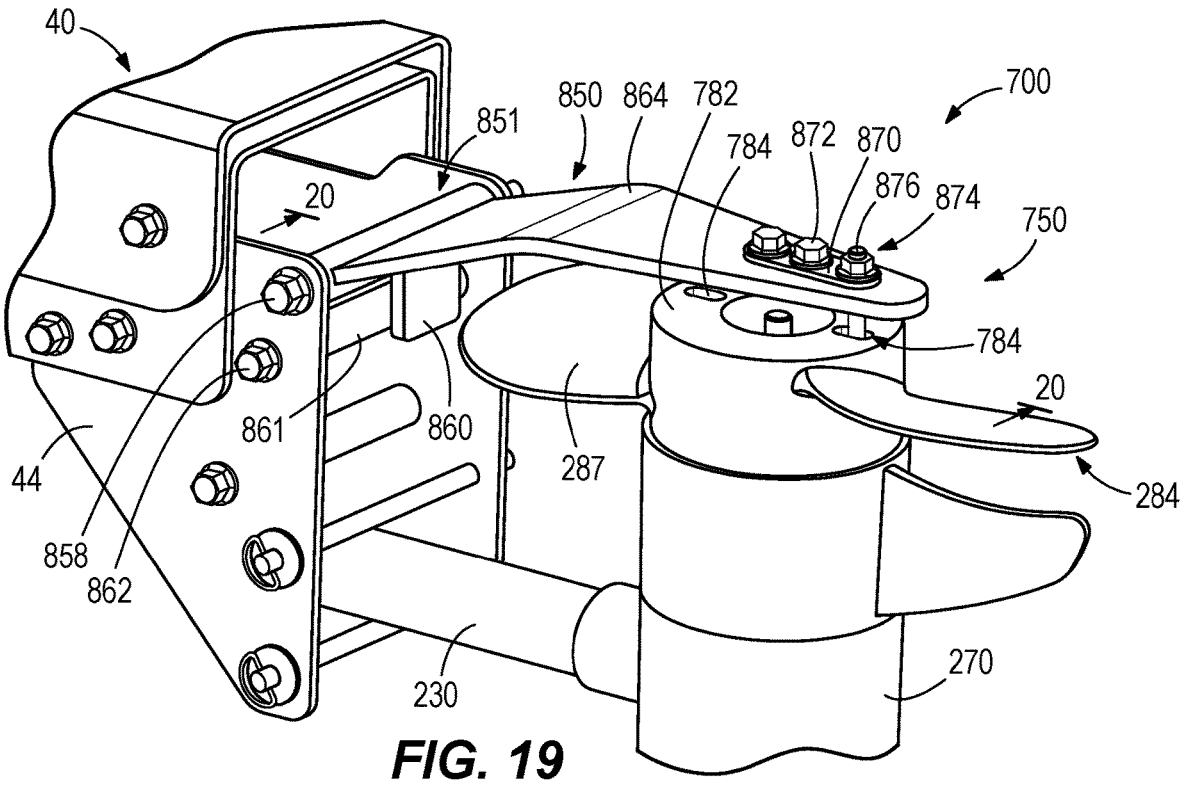
FIG. 19 is a front isometric view of another embodiment of alignment device according to the present disclosure.
Figure 20:
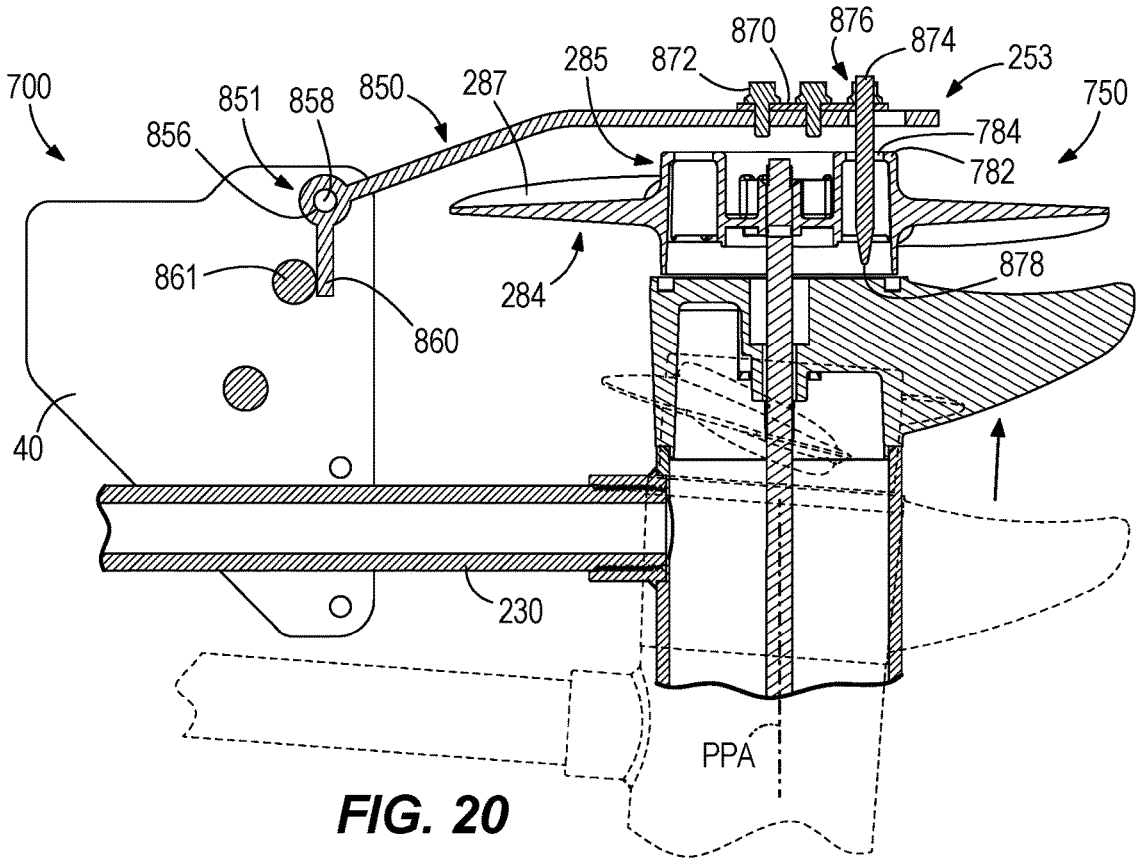
FIG. 20 is a sectional view taken along the line 20-20 in FIG. 19.

FIGS. 19 and 20 depict another alignment device 750 for aligning a propeller 284 within a mounting base 40. This alignment device 750 includes an arm 850 that extends between a first end 851 and second end 853, here with a bend 864 therebetween. An opening 856 is defined near the first end 851, which receives a fastener 858 for retaining the arm 850 between the sides 44 of the mounting base 40. A member 860 extends downwardly from the arm 850 near the first end 851 and is configured to pivot with the arm 850 about the opening 856 such that the arm 850 is a ridged component. A member 861 is also provided between the sides 44 of the mounting base 40, coupled thereto via fasteners 862 such as screws, bolts, or other fastening techniques known in the art. As shown in FIG. 20, the arm 850 is permitted to pivot in the upward direction, but is limited from pivoting further clockwise (or downward) via contact between the member 860 and the member 861.

A plate 870 is coupled near the second end 853 of the arm 850, for example via fasteners 872 such as bolts or screws. It should be recognized that other fastening techniques are also suitable, including welding, adhesives, and/or the like. A pin 874 extends downwardly from the plate 870 between a base 876 and a tip 878. In certain examples, the pin 874 is rigidly coupled to the plate 870. In other examples, the pin 874 extends through an opening in the plate 870 and is biased downwardly by a spring positioned between the base 876 of the pin 874 and the plate 870.

As shown in FIGS. 19-20, an opening 784 is provided within the face 782 in the hub 285 of the propeller 284, in this example two openings 784 generally aligned with the midpoint of the blade faces 281 of the blades 287. The alignment device 750 is configured such that as a propeller 284 rotates while the propulsor 270 is pivoted toward the stowed position, the tip 878 of the pin 874 extending downwardly from the arm 850 skates along the face 782 of the hub 285 until coming into alignment with the opening 784. Once aligned, the pin 874 enters the opening 784 in the hub 285, either through the mass of the arm 850 or the biasing of the pin 874 downwardly. In this manner, the arm 850 is permitted to pivot in the counterclockwise direction relative to that shown in FIG. 20 while the pin 874 skids along the face 782 of the hub 285, but returns to the position shown in FIG. 20 once the pin 874 is received within the opening 784 of the hub 285. Once the pin 874 is received within the opening 784 (corresponding to alignment of the propeller 284), the motor 282 is stopped, for example using the current sensor 720 discussed above.

It should be recognized that while the description above includes examples of alignment devices 750 in which physical contact is made with the propeller 284, other configurations of the elements that make this physical contact are also contemplated by the present disclosure. For example, the arm 760 of FIGS. 11-12, fingers 816 of FIG. 15, blade catcher 830 of FIG. 18, pin 874 of FIG. 20 (for example) may be provided in differing qualities, have a different shapes, be mounted in a different positions, be configured to have resilient or flexible properties, and/or the like.

Figure 21:
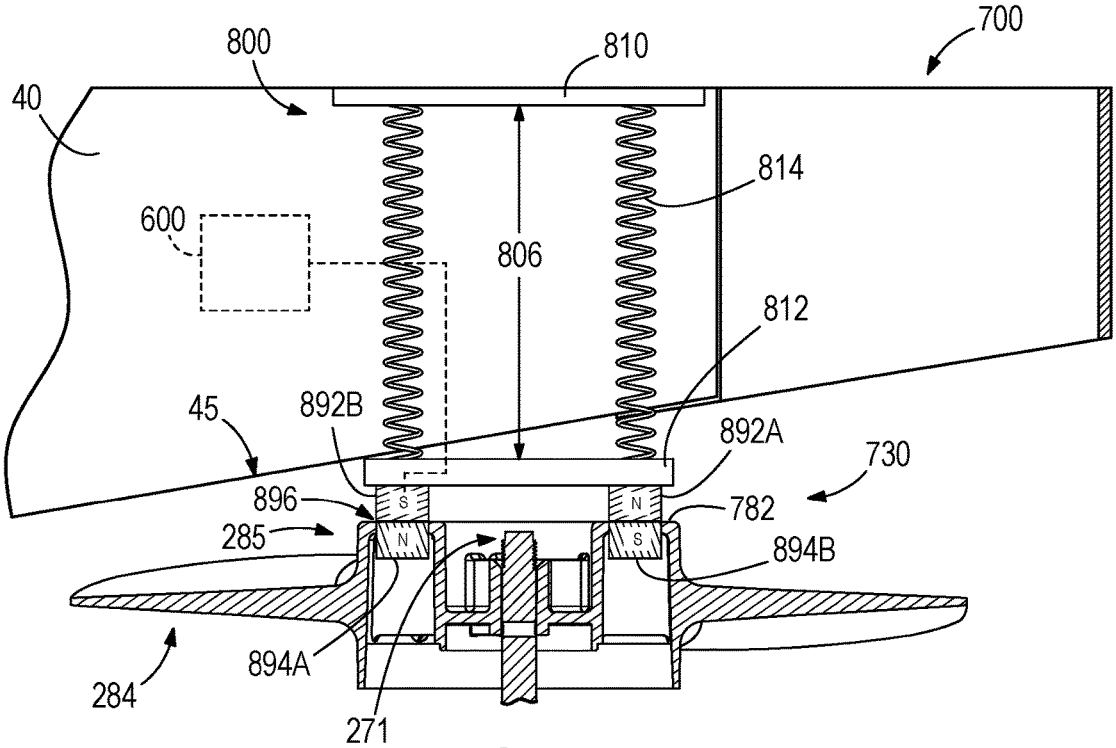
FIGS. 21-22 are sectional side views of another embodiment of alignment device according to the present disclosure showing the propulsor progressively pivoting into the stowed position.
Figure 22:
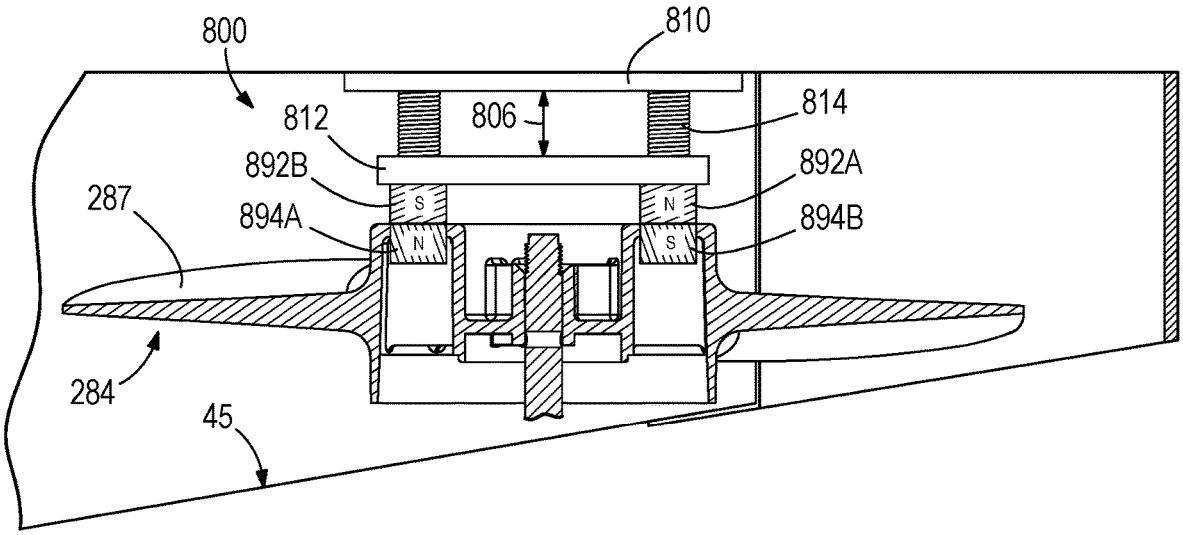

FIGS. 21 and 22 depict another alignment device 750 for aligning the propeller 284 within the mounting base 40. The guide 800 is similar to that previously shown in FIGS. 15 and 16, including a member 812 coupled to a base 810 via springs 814 and separated by a variable distance 806. In this alignment device 750, base magnets 892A and 892B extend downwardly from the member 812 in a similar manner to the fingers 816 of FIGS. 15 and 16. Similarly, hub magnets 894A and 894B are retained within hub recesses 896 defined in the face 782 of the hub 285. The hub magnets 894A and 894B are aligned with the blades 287 such that when the polarities of the base magnets 892A and 892B and hub magnets 894A and 894B are oppositely aligned (in other words, a north pole is aligned with a south pole, and vice versa), the propeller 284 is aligned within the mounting base 40.

The base magnets 892A and 892B and hub magnets 894A and 894B are coupled to a control system 600 and serve as a propeller position sensor 730 (for example, a Hall-effect sensor presently known in the art). In other words, by knowing the geometry and placement of the guide 800 and it's base magnets 892A and 892B, the base magnets 892A and 892B and hub magnets 894A and 894B may be used to determine the rotational position of the propeller 284 relative to the mounting base 840. In this manner, the propeller 284 may be stopped from rotating when the propeller position sensor 730 determines that the blades 287 are in alignment with the mounting base 840.

In certain examples, the current generated by the hub magnets 894A and 894B passing by the base magnets 892A and 892B can be read as a propeller position sensor 730, and/or the attraction and repulsion therebetween sensed as changes to the current drawn by the motor 282 to overcome the magnetic forces. As discussed above, this can be detected by the current sensor 720 to command the motor 282 to stop rotating.

Once the propeller 284 is aligned within the mounting base 840, the springs 814 permit the member 812 to be compressed toward the base 810, allowing the propeller 284 to be further retracted into the mounting base 40 as shown in FIG. 22.

In this manner, FIGS. 21 and 22 exemplifies that the alignment devices and methods for aligning the propeller according to the present disclosure are not limited to having elements that come into physical contact with the propeller 284 (such as the examples of FIGS. 11-20). In other words, the alignment device may be comprised of a control system using one or more sensors, with or without elements that physically contact the propeller. In addition to the sensors described above, the alignment device may also or alternatively include limit switches, capacitive and/or resistive sensors, encoders (e.g., in conjunction with the actuator 240 or within the pivot rotation device 150), optical sensors, and/or other positional detection mechanisms presently known in the art to detect the position of the shaft 230 and propulsor 270 and/or control rotation of the propeller 284 as the propulsor 270 moves towards the stowed position, for example.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A propulsion device for a marine vessel, the propulsion device comprising:

a base configured to be coupled to the marine vessel, the base having sides that extend downwardly from the marine vessel;

a propulsor pivotally coupled to the base and pivotable into and between a deployed position and a stowed position, wherein the propulsor comprises a propeller having a hub with blades extending away therefrom, and wherein the propulsor is configured to propel the marine vessel in water when in the deployed position by rotating the propeller; and an alignment device that aligns the blades of the propeller between the sides of the base when the propulsor is in the stowed position.

2. The propulsion device according to claim 1, wherein the alignment device is an arm having a first end coupled to the base and a second end that is moveable relative to the base between a stowed position and a deployed position, wherein the second end is closer to the base in the stowed position than in the deployed position, and wherein the arm engages the blades to position the blades between the sides of the base.

3. The propulsion device according to claim 2, wherein the arm has upper and lower edges each extending between the first end and the second end, wherein a height is defined between the upper and lower edges, and wherein the height progressively increases from the first end to the second end.

4. The propulsion device according to claim 2, wherein the first end of the arm is pivotably coupled to the base, and wherein the second end is at least partially positioned inside the base when the propulsor is in the stowed position.

5. The propulsion device according to claim 2, further comprising a control system that causes the propeller to rotate as the propulsor pivots toward the stowed position.

6. The propulsion device according to claim 5, further comprising a position sensor that determines a position of the propulsor between the deployed position and the stowed position, wherein the control system causes the propeller to rotate based on the position of the propulsor determined.

7. The propulsion device according to claim 5, further comprising a current sensor that senses a current drawn by the propulsor, and wherein the control system is configured to stop rotating the propeller when the current sensed by the current sensor exceeds a predetermined threshold.

8. The propulsion device according to claim 5, wherein the control system is configured to stop rotating the propeller after a predetermined time.

9. The propulsion device according to claim 1, further comprising a control system that causes the propeller to rotate as the propulsor pivots toward the stowed position.

10. The propulsion device according to claim 9, wherein the control system is configured to stop rotating the propeller after a predetermined time of pivoting the propulsor toward the stowed position.

11. The propulsion device according to claim 9, further comprising a propeller position sensor that detects a rotational position of the propeller, wherein the control system is configured to stop rotating the propeller based on the rotational position detected by the propeller position sensor.

12. The propulsion device according to claim 11, wherein the propeller position device includes a magnet coupled to one of the propeller and the base.

13. The propulsion device according to claim 1, wherein the alignment device is an arm having first and second ends, the second end extending downwardly from the base, wherein a stop is defined within the hub of the propeller, wherein the second end engages the stop when the propeller is aligned with the base, and wherein the engagement between the second end and the stop resists rotation of the propeller.

14. The propulsion device according to claim 13, further comprising a control system that causes the propulsion device to rotate the propeller as the propulsor pivots toward the stowed position, and further comprising a current sensor that senses a current drawn by the propulsor, wherein the control system is configured to stop rotating the propeller when the current sensed by the current sensor exceeds a predetermined threshold.

15. The propulsion device according to claim 1, further comprising an actuator operatively coupled to pivot the propulsor between the deployed position and the stored position, wherein operating the actuator causes the propulsor to pivot about a transverse axis, and further comprising a gearset coupling the propulsor to the base, wherein the gearset rotates the propulsor about the length axis perpendicular to the transverse axis when the propulsor is pivoted between the stowed position and the deployed position along the transverse axis.

16. A method for making a propulsion device for a marine vessel, the method comprising:

configuring a base for coupling to the marine vessel, the base having sides that extend downwardly from the marine vessel;

pivotally coupling a propulsor to the base, the propulsor being pivotable into and between a deployed position and a stowed position, wherein the propulsor comprises a propeller having a hub with blades extending away therefrom, and wherein the propulsor is configured to propel the marine vessel in water when in the deployed position by rotating the propeller; and coupling an alignment device between the propeller and the base, wherein the alignment device is configured to align the blades of the propeller between the sides of the base when the propulsor is in the stowed position.

17. The method according to claim 16, further comprising configuring a control system to cause the propeller to rotate as the propulsor pivots toward the stowed position.

18. The method according to claim 16, wherein the alignment device is an arm having a first end coupled to the base and a second end that is moveable relative to the base between a stowed position and a deployed position, wherein the second end is closer to the base in the stowed position than in the deployed position, and wherein the arm engages the blades to position the blades between the sides of the base.

19. The method according to claim 16, wherein the arm has upper and lower edges each extending from the first end to the second end, and wherein a height is defined between the upper and lower edges, further comprising forming the arm such that the height progressively increases from the first end to the second end.

20. The method according to claim 16, further comprising configuring a control system to cause the propeller to rotate when the propulsor pivots toward the stowed position, further comprising operatively connecting a current sensor to sense a current drawn by the propulsor, and further comprising configuring the control system to stop rotating the propeller when the current sensed by the current sensor exceeds a predetermined threshold.

* * * * *